United States Patent [19]

Shibata et al.

[11] Patent Number: 5,030,998

[45] Date of Patent: Jul. 9, 1991

[54] TONER CARTRIDGE HAVING EASILY REMOVABLE TONER SUPPLY OPENING SEAL MEMBER

[75] Inventors: Kiyotaka Shibata, Takatsuki; Kiyoshi Morimoto, Osaka, both of Japan

[73] Assignee: Mita Industrial Co., Ltd., Japan

[21] Appl. No.: 524,578

[22] Filed: May 17, 1990

[30] Foreign Application Priority Data

Jul. 18, 1989 [JP] Japan ..... 64-186538
May 31, 1989 [JP] Japan ..... 64-139477

[51] Int. Cl.[5] ..... G03G 15/06
[52] U.S. Cl. ..... 355/260; 355/245
[58] Field of Search ..... 355/215, 245, 260; 118/653; 222/DIG. 1; 206/631, 633

[56] References Cited

U.S. PATENT DOCUMENTS 4,614,286 9/1986 Yamaguchi et al. ..... 222/DIG. 1 X
4,615,608 10/1986 Mizutani ..... 222/DIG. 1 X
4,799,608 1/1989 Oka ..... 222/DIG. 1 X
4,895,104 1/1990 Yoshino et al. ..... 118/653

FOREIGN PATENT DOCUMENTS 0041068 3/1985 Japan ..... 355/245
0085760 4/1988 Japan ..... 355/260
0206782 8/1988 Japan ..... 355/245
0281177 11/1988 Japan ..... 355/260
0074573 3/1989 Japan ..... 355/215

*Primary Examiner*—A. T. Grimley
*Assistant Examiner*—William J. Royer
*Attorney, Agent, or Firm*—Beveridge, DeGrandi & Weilacher

[57] ABSTRACT

A toner cartridge with a cartridge body having a toner supply opening, a seal member, having a folded part, for closing the toner supply opening with a portion between the folded part and an end, and a rolling mechanism for rolling up the seal member from the end which is free of the closing of the toner supply opening. Both side ends of the seal member near the rolling mechanism are different in length between the folded part and the rolling mechanism. Another toner cartridge has a plurality of seal members which have different length. The toner cartridges may have a pressing member for pressing the outer surface of the seal member rolled up by the rolling mechanism. These toner cartridges can be applied to a developing unit in a copying machine.

32 Claims, 21 Drawing Sheets

TONE CARTRIDGE HAVING EASILY REMOVABLE TONER SUPPLY OPENING SEAL MEMBER

BACKGROUND OF THE INVENTION

The present invention relates to a toner cartridge. More specifically, it relates to a toner cartridge for use in a developing unit of an image forming apparatus such as an electrostatic copying machine.

REMOVING A SEAL MEMBER

A developing unit of an electorostatic copying machine consists mainly of a developing device and a toner hopper (referred to as a hopper below) supplying toner to the developer. To supply toner to the hopper, for example, a toner cartridge containing toner is mounted on the hopper, and a seal member covering an opening at the bottom of the toner cartridge is removed.

The seal member adheres to the peripheral portion of the opening of the toner cartridge with, for example, adhesive. According to a conventional method for removing the seal member from the toner cartridge, as shown in FIGS. 1 and 2, a folded seal member 91 closes a toner supply opening 93 of a cartridge body 92, wherein its portion between the folded part and an end 91*a* is pulled by hand at the end for removal. Moreover, Japanese Utility Model Laying-Open No. 117170/1986 discloses that a roller rolls up a seal member. FIGS. 3 and 4 are bottom views of toner cartridges showing the seal member 91 of FIGS. 1 and 2 not removed. In terms of the contact surface area of a portion of the seal member 91 adhered to the cartridge body 92, portions A, A′ as removed first and portions B and B′ as removed last are greater than mid-portions C, C′, D and D′, in both FIGS. 3 and 4. Therefore, during removal of the seal member 91, the adhered portions A, A′, B and B′ require relatively large force, thereby making it difficult to handle the toner cartridge. Particularly, in the case shown in FIG. 4, more force is required to remove the seal member 91 in the direction Y than in the case shown in FIG. 3 in the direction X.

Meanwhile, U.S. Pat. No. 4,827,307, Japanese Utility Model Laying-Open No. 115752/1983, Japanese Patent Laying-Open No. 53868/1984 and Japanese Patent Laying-Open No. 14865/1983, disclose that adhered portions of a seal member to a cartridge body are formed at an angle, which is not a right angle, to a direction of removing the seal member.

If the structure disclosed in the above documents is applied to the toner cartridge in FIG. 4, the structure shown in FIG. 5 is obtained. That is, an adhered portion 94 of a seal member 91 to a toner cartridge body 92 for closing a toner supply opening 93 is thereby mountain-shaped.

In this structure, however, the angle of adhered portion 94 to the direction of removing cannot be too sharp, because the toner supply opening 93 must be kept sufficiently large relative to the cartridge body 92, which moreover must be as compact as possible in terms of occupied space. Therefore, even if the above conventional technology, such as it is, is applied directly to the toner cartridge shown in FIGS. 4 and 5, it still cannot be sufficiently effective whereby the seal member may be most easily removed at the onset of removal.

Japanese Utility Model Laying-Open No. 77347/1983 discloses a toner cartridge which has two seal members each with a hook at its end. Each seal member has a different length. In this example, the hooks of the seal members catch an edge of a cartridge-receiving opening of a copying machine body at different timings, when the cartridge is inserted into the receiving opening, so that each seal member has its own start timing of removal as different from the other. Therefore less force is required to remove the seal members, whereby the removing work is facilitated.

However, since one hook of the seal member must catch the particular edge portion of the receiving opening after the other when the cartridge is inserted, it is difficult to insert the cartridge without deviating from its necessary alignment.

CONDITION AFTER ROLLING UP SEAL MEMBER

In order to obtain improvement in the removing of a seal member, Japanese Utility Model Laying-Open No. 117170/1986 discloses a toner cartridge which incorporates a roller to roll up a seal member. However, if a seal member made of a material having a strong restitution, or a strong tendency of being flat, is used in the toner cartridge incorporating the roller, the rolled seal member bulges due to its restitution, thereby enlarging its diameter. This means that the rolled seal member cannot be stored in a compact space. Furthermore, toner carried on the seal member may be scattered due to the restitution of the seal member. Accordingly, the material of the seal member must be less restitutive to diminish its tendency toward flatness. This means the variability of material must be narrowed.

The toner cartridge should have a one-way mechanism or the like to fix the direction of rolling. Otherwise, the surface of the seal member with adsorbed toner may be outside the roller, wherein the toner contaminates the atmosphere.

SUMMARY OF THE INVENTION

It is an object of the present invention to provide a toner cartridge in which a seal member can be easily removed from a cartridge body with minimal force.

It is another object of the present invention to provide a toner cartridge in which a seal member can be removed from a cartridge body with minimal force and which can be easily set in an image forming apparatus.

It is yet another object of the present invention to provide a toner cartridge having a roller to roll up a seal member, whereby the diameter of the rolled seal member is reduced and toner is minimally scattered.

(1) A toner cartridge according to an aspect of the present invention comprises a cartridge body having a toner supply opening, a seal member, and rolling means for rolling up the seal member. The seal member is folded and the part of the seal member between the folded part and an end closes the toner supply opening. The lengths of the seal member between the folded part and the rolling means are different along each side end. The rolling means is for rolling up the seal member from the end of that part of the seal member which is not used for closing the toner supply opening.

According to an aspect of the present invention, the start of removal of the seal member from the cartridge body by the rolling means is at that point which has the shortest length between the folded part and the rolling means. Therefore, the seal member is removed gradually so that less force is required when starting to remove it.

For example, in the case that the toner supply opening is rectangular and the seal member is removed in the direction perpendicular to the longitudinal direction of the opening, less maximum force is required to remove the seal member according to the present invention, because the largest area of the adhered part removed at any one moment is smaller than that of the conventional type.

(2) A toner cartridge according to another aspect of the present invention comprises a cartridge body having a toner supply opening, seal means including a plurality of seal members each having a folded part, and a roller.

The seal members each close the toner supply opening with a part between the folded part and an end. The lengths of the parts of the seal members between their folded parts and the roller are different. The parts of the seal members which are not used for closing the toner supply opening have an end fixed to the roller. The roller is for rolling up the seal members from the end of the seal members which is not used for closing the toner supply opening.

According to the present invention, the roller rolls up the seal members from shorter to longer successively in order of the length between the folded part and the roller. Therefore, the roller requires reduced force in order to remove the seal member. Since the roller rolls up all the seal members together, the toner cartridge can be operated easily and made compact, furthermore the toner cartridge thereby can be set smoothly in an image forming apparatus.

(3) A toner cartridge according to another aspect of the present invention comprises a cartridge body having a toner supply opening, a seal member for closing the toner supply opening, a roller for rolling up the seal member placed on the cartridge body, and a pressing member for pressing the outer surface of the seal member rolled up by the roller.

In this aspect, the seal member is rolled up with the roller after the toner cartridge is fixed. Since the outer surface of the rolled seal member is pressed by the pressing member, bulging of the rolled seal member due to its restitution is minimized.

In a case in which the pressing member extends laterally between the side ends of the seal member, it can clean the toneradsorbed surface of the seal member in order not to contaminate the atmosphere, even if the seal member is rolled with the toneradsorbed surface outside.

These and other objects and advantages of the present invention will be more fully apparent from the following detailed description.

DESCRIPTION OF THE PREFERRED EMBODIMENT

Outline of Copying Machine Structure

Figure 1:
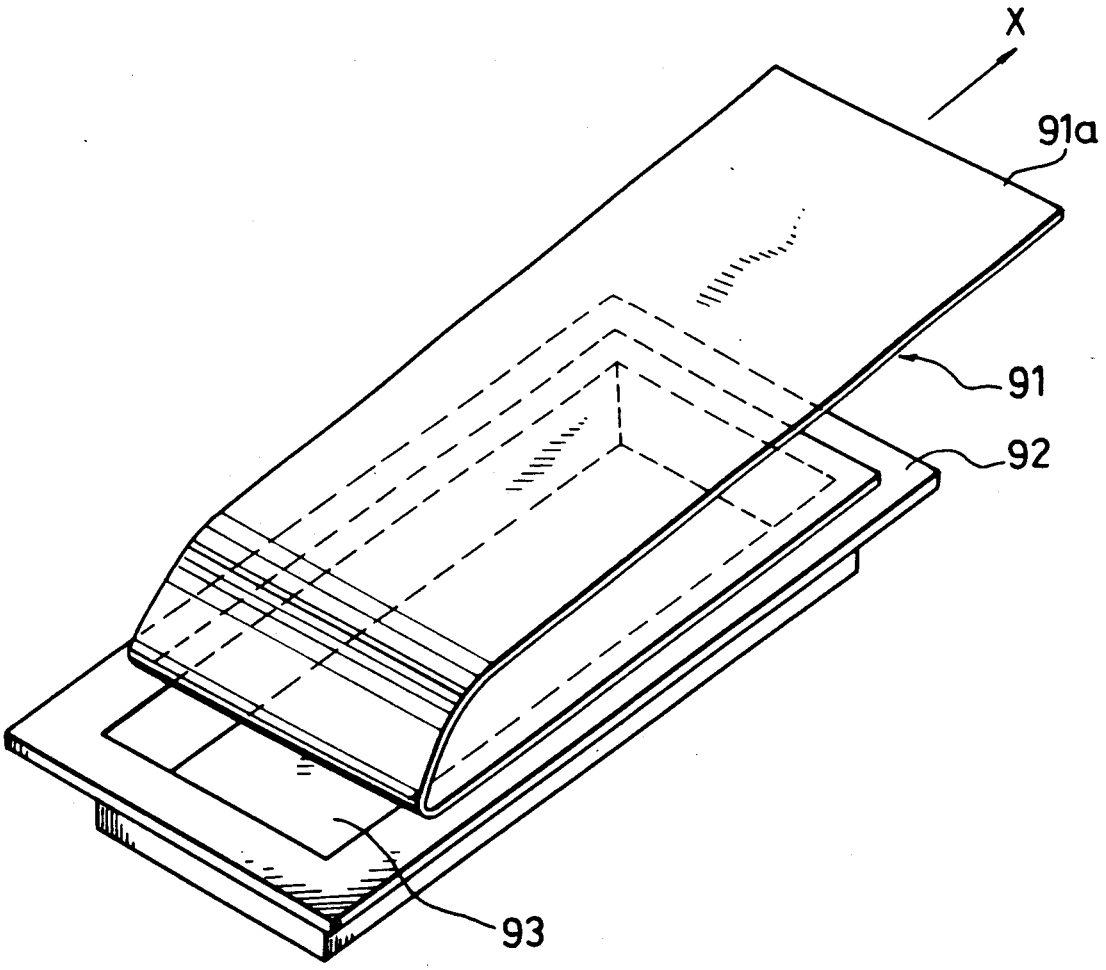
FIG.1 (PRIOR ART)
FIGS. 1 and 2 are isometric views showing seal members removed from cartridge bodies.
Figure 2:
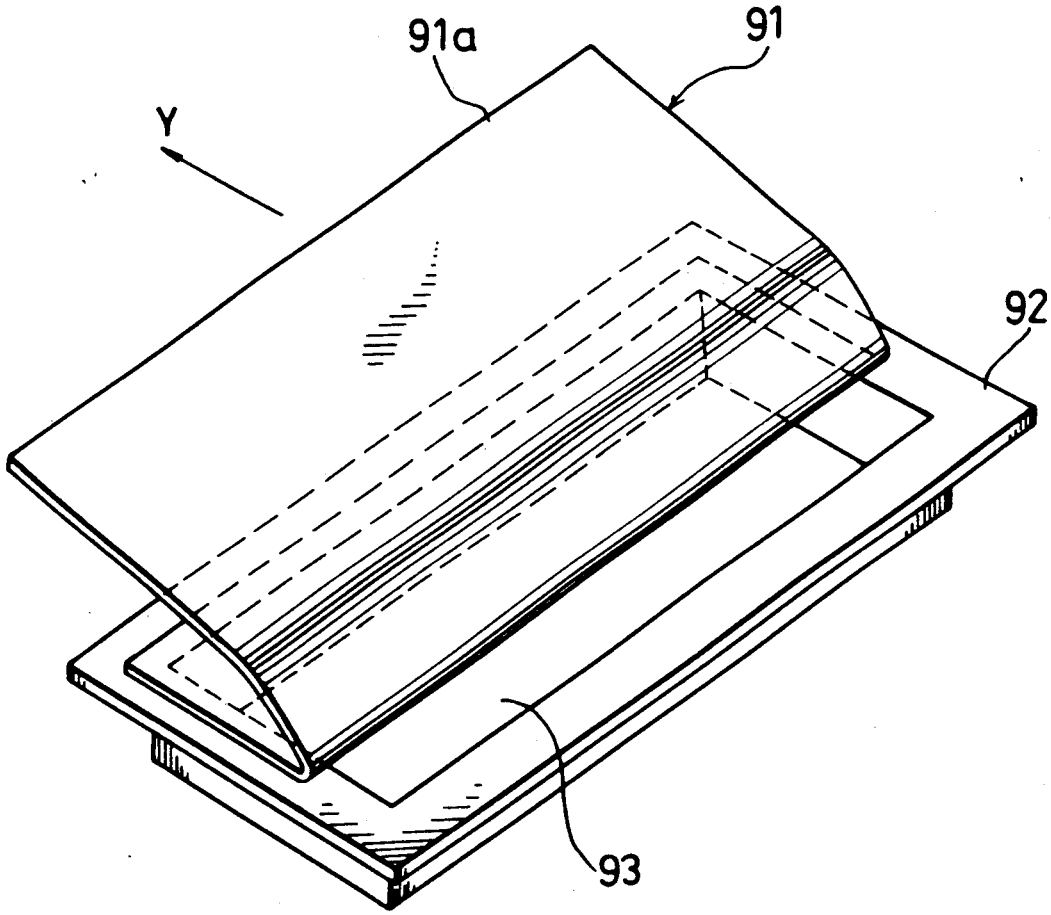
FIG. 2 (PRIOR ART)
Figure 3:
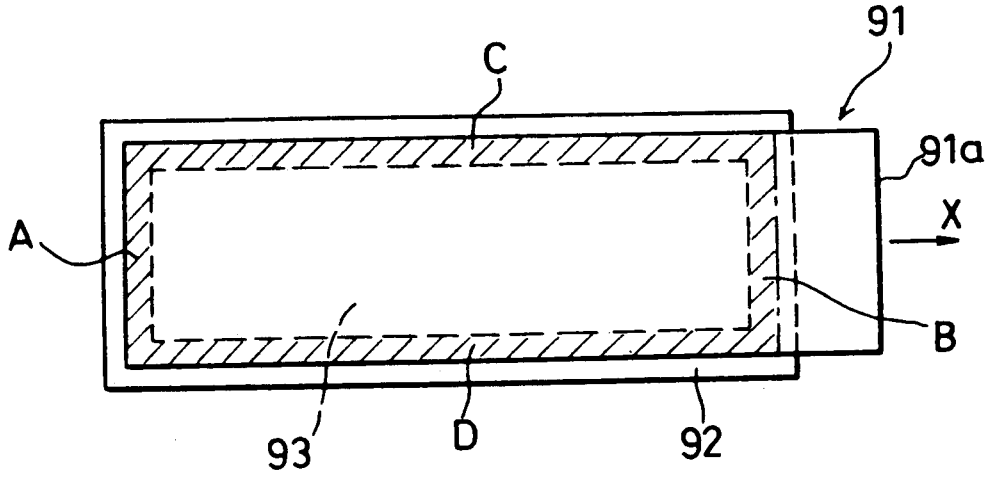
FIG. 3 (PRIOR ART)
FIGS. 3 and 4 are bottom views showing conventional toner cartridges.
Figure 4:
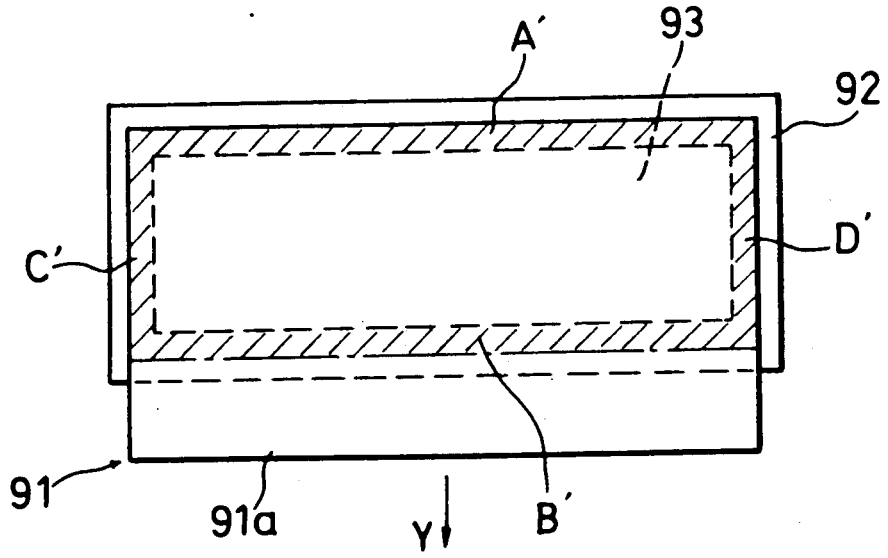
FIG. 4 (PRIOR ART)
Figure 5:
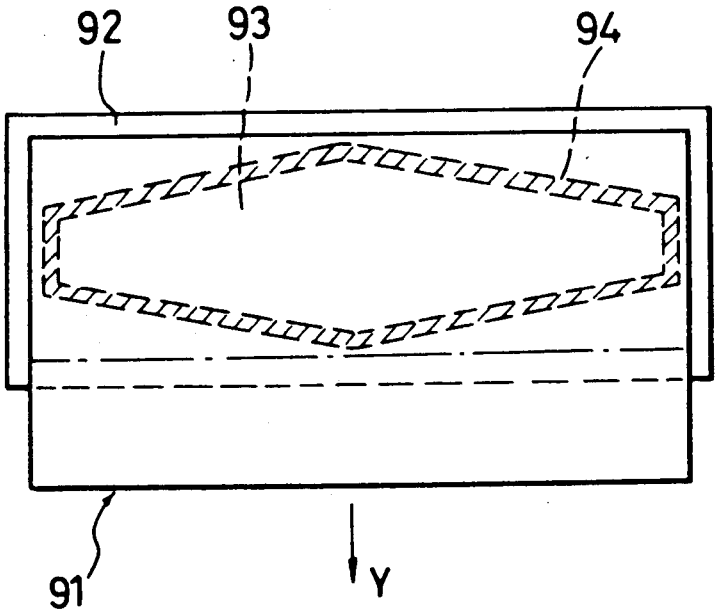
FIG. 5 is a bottom view of a toner cartridge for explaining problems of the prior art.
Figure 6:
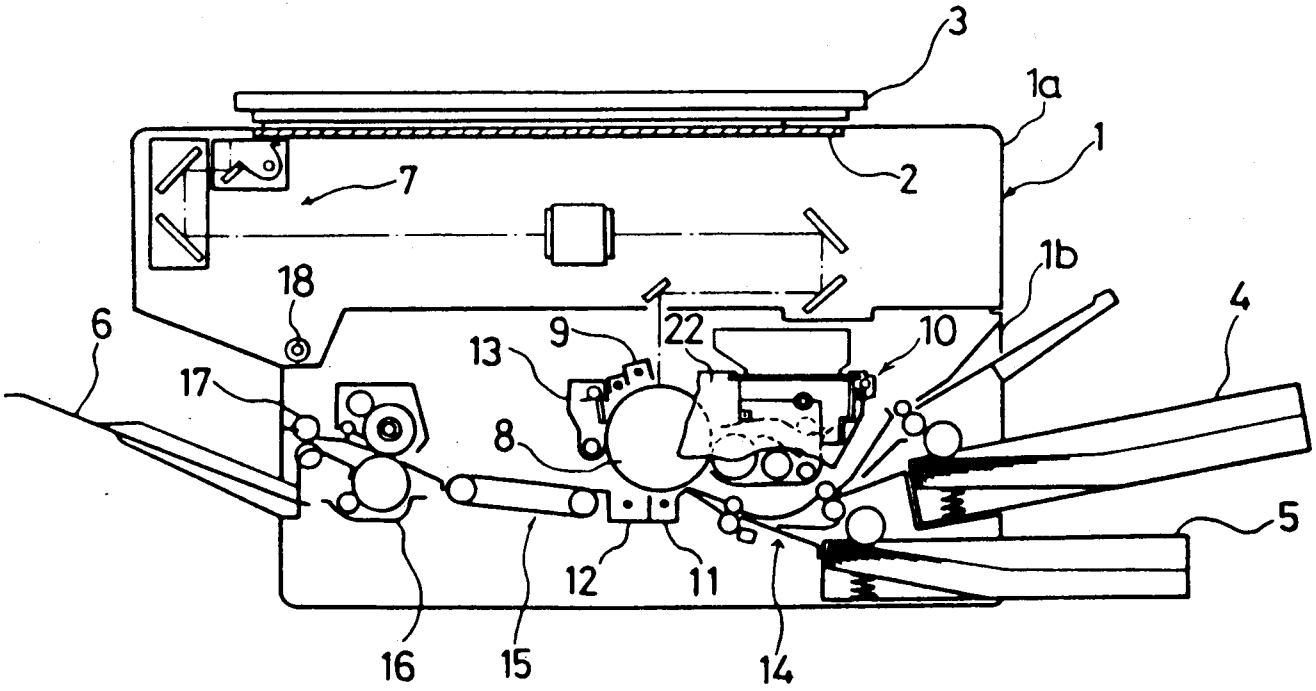
FIG. 6 is a sectional, schematic view showing a copying machine having a toner cartridge according to the present invention.

FIG. 6 shows the outline of the structure of an electrostatic-process copying machine having a toner cartridge in accordance with an embodiment of the present invention.

A machine body 1 consists of the upper portion 1*a* and the lower portion 1*b*. The upper portion 1*a* can pivot on a hinge 18 at the left side of the figure to open the machine body 1. The machine body 1 has a contact glass 2 in the upper surface and an original holder 3 thereon which can be opened. On the right side of the machine body in the figure, detachable paper cassette cases 4 and 5 are attached. On the left side of the machine body 1, a copy tray 6 is attached wherein copied paper is received.

In the machine body 1, an optical exposure system 7 for obtaining information from the original image is located in the upper portion 1*a*. The exposure system 7 consists of a light source, mirrors and lenses. Disposed, as a photoconductor, in the central part of the lower portion 1*b* is a photoconductive drum 8 on which an electrostatic image is formed. Surrounding the photoconductive drum 8, there is an image forming part which consists of a corona-generating device 9 for charging the photoconductive drum 8 with a predetermined level of electric charge, a developing unit 10 for developing an electrostatic image, a transfer unit 11 for transferring a toner image to paper, a detach unit 12 for detaching paper from the photoconductive drum 8, and a cleaning unit 13 for removing toner from the photoconductive drum 8, in that order. A paper transferring path 14 is provided between the paper cassette cases 4 and 5 and the image forming part. In a part of the paper stream lower than the image forming part, a paper transportation device 15 is provided. A fixing unit 16 for fixing a transferred image on the fed paper is disposed between the paper transferring device 15 and the copy tray 6. Beyond the fixing unit 16 in the paper flow, a pair of rollers 17 are provided for disposing of paper to the copy tray 6.

Outline of Structure of Developing Unit

Figure 7:
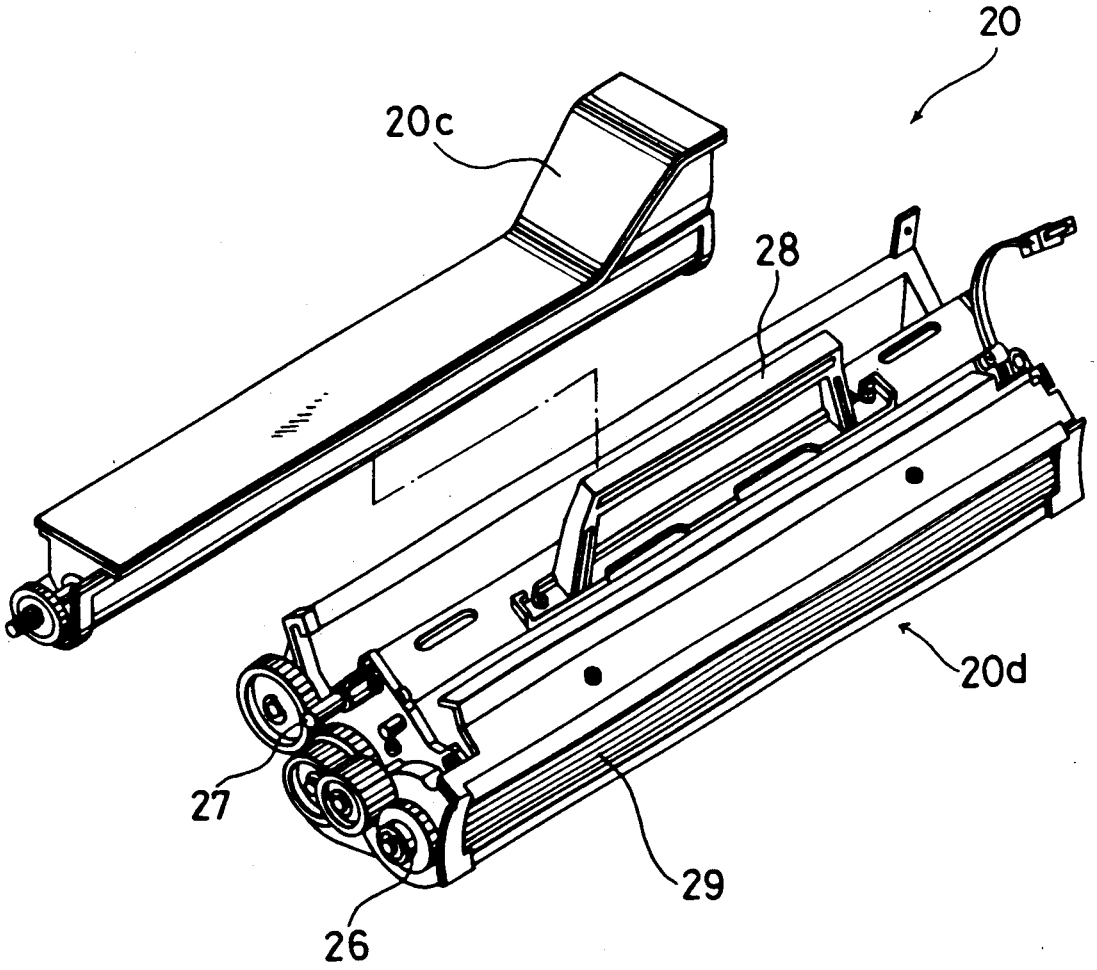
FIGS. 7, an isometric view, and 8, a sectional view, show decomposed parts of a developing unit of the copying machine.
Figure 8:
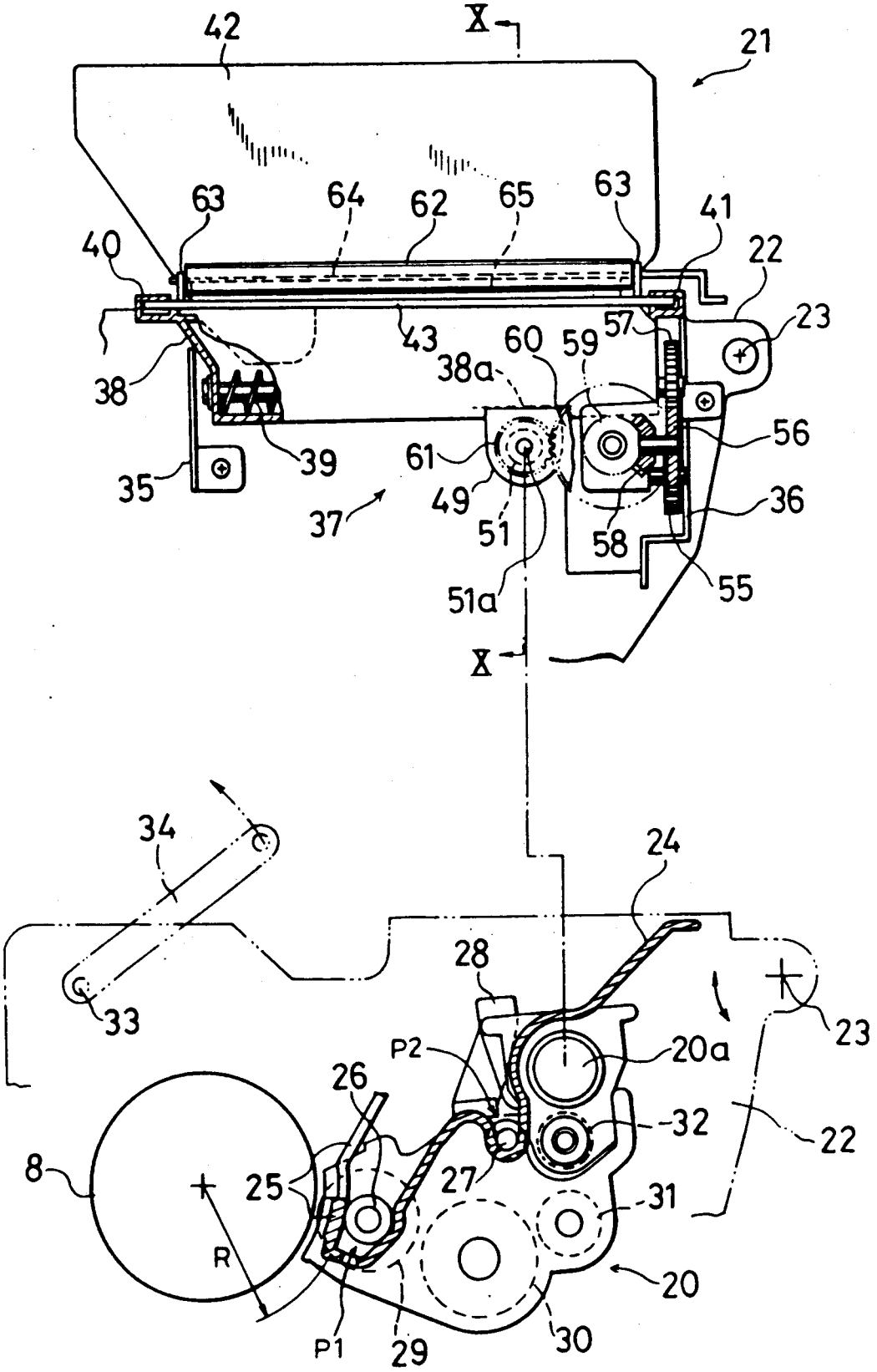

Referring to FIG. 8, the developing unit 10 consists mainly of a developing device 20 and a hopper 21 for supplying toner to the developing device 20. The developing device 20 consists of a body **20*d* and a supply part 20*c* on the body 20*d* (shown in FIG. 7). The developing device 20 is placed between a front plate 22 and a back plate (not shown), where the side of the copying machine closer to an operator is referred to as the front side and the side opposite is referred to as the back side. The developing device 20 is slidable in the direction perpendicular to the axis of the photoconductive drum 8, or upward in this embodiment, to be attached and detached. The front plate 22 located at the front in the lower part 1*b* is pivotable upward, or clockwise, on a fulcrum 23, from the position shown in FIG. 8. The back plate, located at the back in the lower portion 1*b*, is pivotable in the same manner as the front plate 22**.

Figure 9:
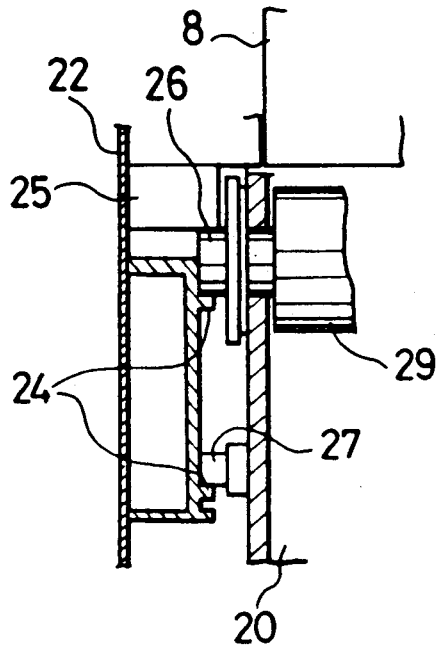
FIG. 9 is a sectional partial view of a fixing part of the developing unit.

Referring to FIGS. 8 and 9, guides 24 and 25 for guiding the developing device 20 to the predetermined position are formed on the inside of the front plate 22 and of the back plate. Meanwhile, the developing device 20 has support members 26 and 27 on its side walls which project into the guides 24 and 25. The support members 26 and 27 are supported by a first pocket P1 and a second pocket P2 formed by the guides 24 and 25.

In the first pocket P1, an inside surface of the guide 25 supporting the support member 26 of the developing device 20 comprises part of an arc of radius R whereof the center coincides with the axis of the photoconductive drum 8. In addition, a handle 28 is attached to the upper part of the developing device 20 in order to draw up the developing device 20.

Structure of Developing Device

Figure 10:
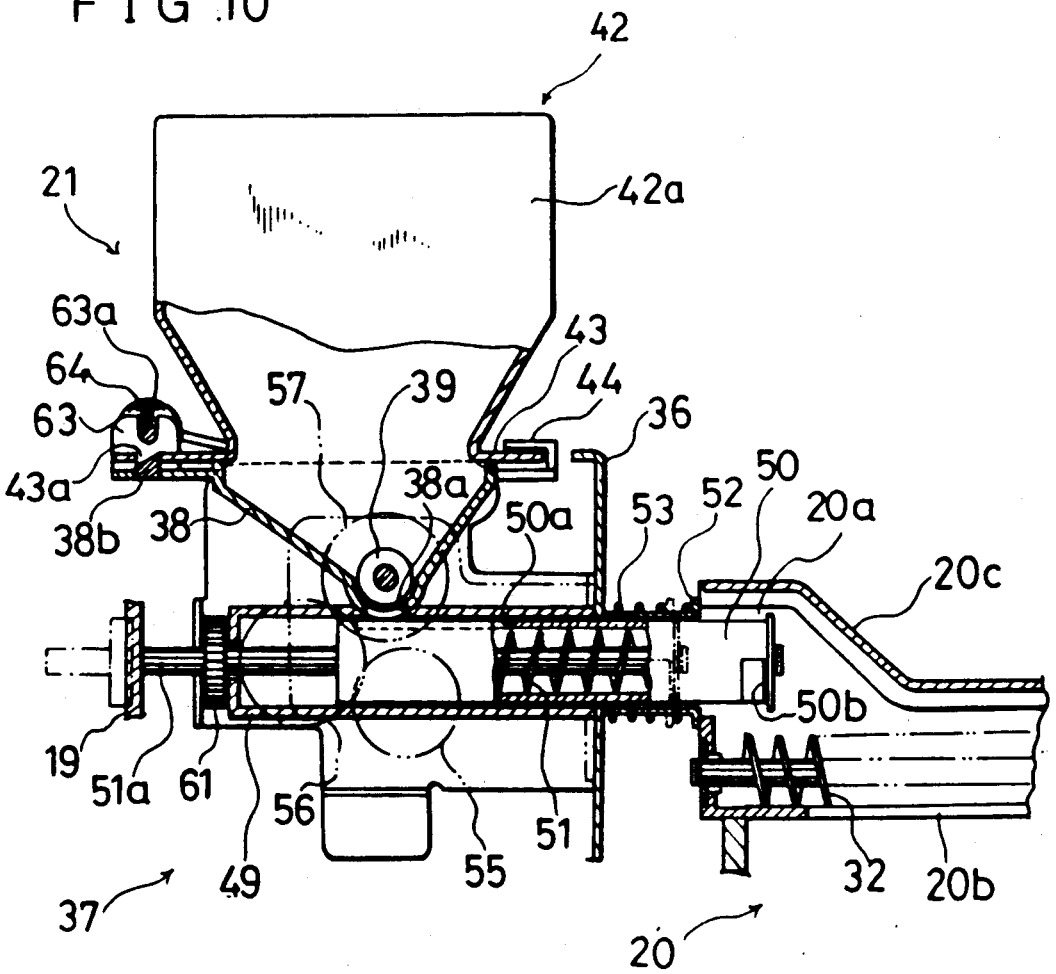
FIG. 10 is a sectional view taken along the line X—X of FIG. 8.
Figure 11:
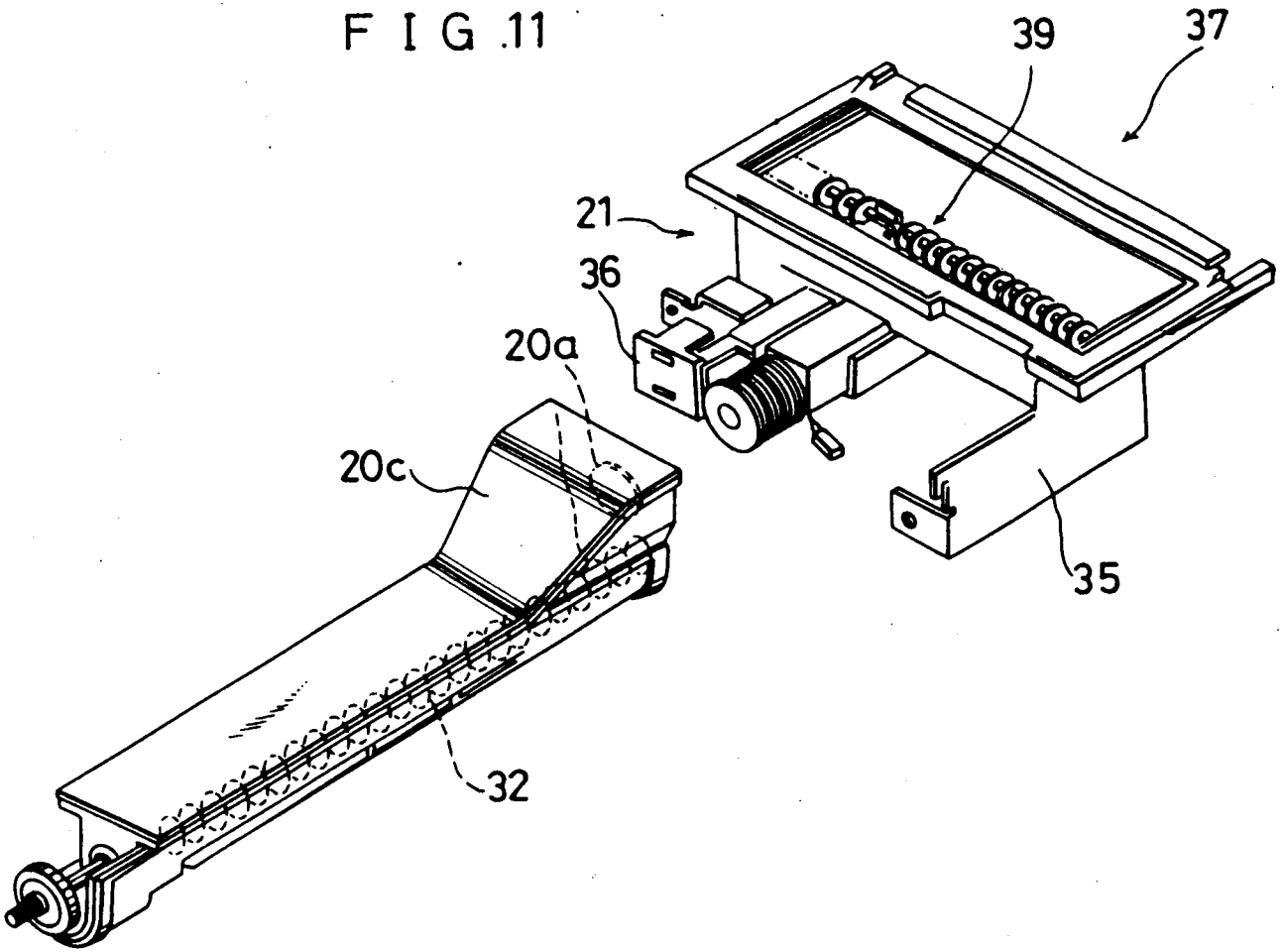
FIGS. 11 and 12 are isometric views showing toner transporting paths between a hopper and a developing device.

Similarly to the conventional developing device, the developing device 20 has in its body **20*d* a developing roller 29 for supplying toner to the photoconductive drum 8, a scooping rotor 30 for scooping developer consisting of toner and carrier to the developing roller 29, and an agitation roller 31 for agitating the developer in the developing device 20, all of which are rotatable. Above the agitation roller 31, a spiral 32, shown in FIGS. 10 and 11, is rotatably provided for transferring toner supplied from the hopper 21, described below, in the lateral direction of the developing device 20. Furthermore, an opening 20*a* connected to the hopper 21 is formed in the front wall of the supply part 20*c* above the spiral 32, as shown in FIGS. 8, 10 and 11. A link member 34 is pivotally connected with a pin 33 to the upper part of the left end, in FIG. 8, of the front plate 22 which supports the developing device 20 and the photoconductive drum 8. The upper end of the link member 34 is pivotally connected to the upper portion 1*a* of the copying machine body 1**.

Structure of Hopper

Referring to FIGS. 8, 10 and 11; the hopper 21 is disposed in the front of the developing device 20, and fixed to the front plate 22 with supporting plates 35 and 36. The hopper 21 consists mainly of a hopper body 37 and a cartridge 42.

Hopper Body

The hopper body 37 has a toner container 38 for containing toner. The toner container 38 has a pair of inside walls at both ends in the widthwise direction, which slope to make a "V", as in the sectional side view, and another pair of inside walls at both ends in the direction perpendicular to the widthwise direction, which slope as well. Accordingly, the container 38 opens out at its upper end. The toner container 38 has holders 40 and 41, whereof the sectional shape is similar to a "C", at the upper left and right ends. The holders 40 and 41 hold a flange 43 surrounding the opening of the toner cartridge 42, as described below. Referring to FIG. 10; another holder 44 is formed in the rear portion of the toner container 38. The holder 44 holds the flange 43 of the toner cartridge 42 similarly to the holders 40 and 41.

Referring to FIGS. 10, 12, 14 and 15; a toner supply opening **38*a* for allowing toner to drop is formed at the bottom of the toner container 38. The toner supply opening 38*a* is formed slightly on the right (in FIG. 8) of the middle in the lengthwise direction of the toner container 38 to correspond to the connecting opening 20*a* of the developing device 20, as in the view in FIG. 8. In the bottom portion of the toner container 38, a transfer means 39 is disposed to transfer the toner in the container 38 to the opening 38*a*. The transfer means 39 consists of a rod 39*d* and a transfer member. The transfer member consists of a rotor 39*a* having four wings 45, above the toner supply opening 38*a*, and a pair of spirals 39*b* and 39*c* opposite to each other in terms of twisting direction for transferring the toner to the rotor 39*a*** on either side of it.

Figure 14:
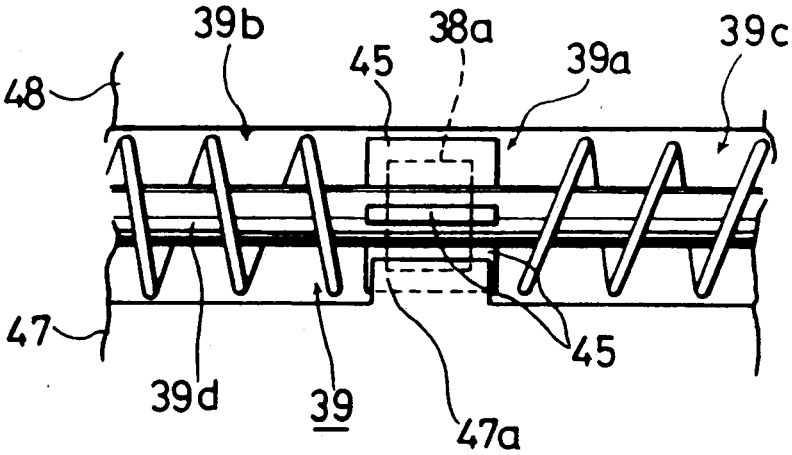
FIG. 14 is a plan view showing a part of a container.
Figure 15:
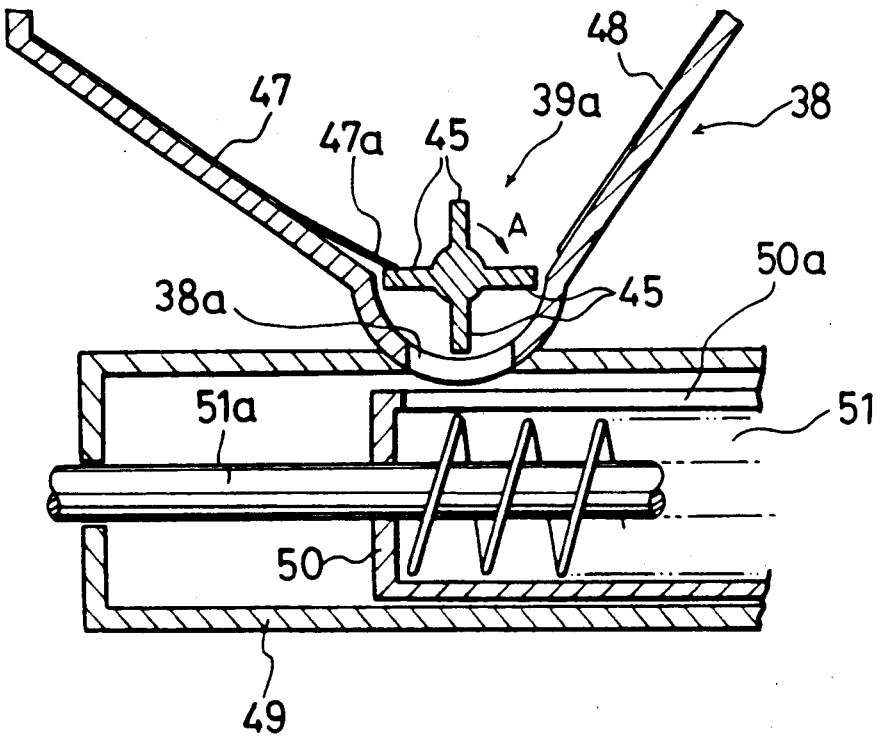
FIG. 15 is a vertically sectional view of the bottom part of the container.

The rotor **39*a*, as shown in FIGS. 14 and 15, covers the toner supply opening 38*a* with its wings 45** whereby an excessive amount of toner cannot be supplied at a given time.

Figure 13:
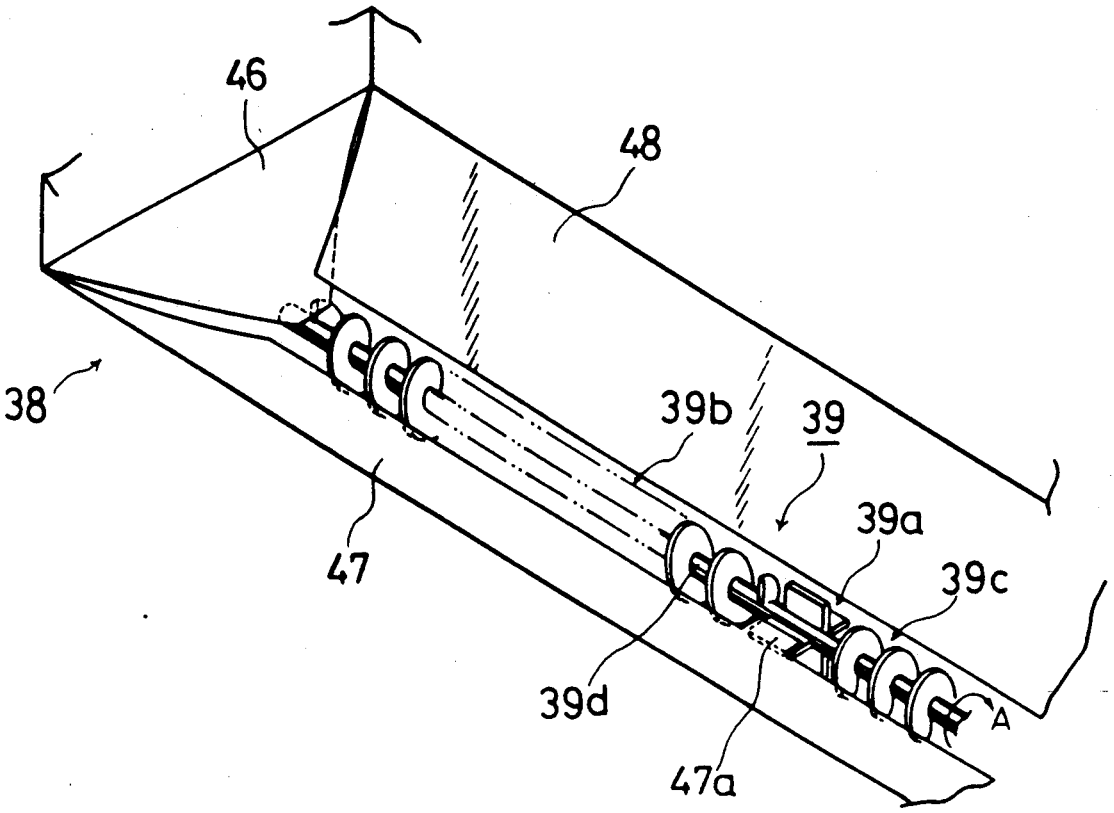
FIG. 13 is an isometric view showing the inside of a toner container.

Referring to FIG. 13; placed on a pair of sloping walls of the toner container 38 are side swing plates 46 (one of which is shown in FIG. 13), a front swing plate 47 and a rear swing plate 48, made of elastic material such as polyester film. Each swing plate 46 is attached to the inside surface of the container 38 at its upper portion, leaving its lower portion free. Each bottom end of the side swing plates 46 is on an end of the spiral **39*b*. The bottoms of the side portions of the rear swing plate 48 are placed on the side swing plates 46 so that the rear swing plate 48 is swung by the oscillation of the side swing plates 46**.

Part of the bottom portion of the front swing plate 47 has a projection **47*a*. The projection 47*a* is placed on the wing 45 adjacent to the front swing plate 47, as shown in FIGS. 13–15. The direction of the rotation of the transfer means 39 as shown with an arrow A in FIGS. 13 and 15 is predetermined whereby the projection 47*a* cannot be bent down towards the opening 38*a***.

Referring to FIGS. 8 and 10; a cylindrical casing 49 provided below the toner container 38 extends in the direction perpendicular to the transfer member 39. In the cylindrical casing 49, a toner supply pipe 50 is slidably inserted. An upper opening 50*a* is formed in the upper portion of the toner supply pipe 50. The opening 50*a* always connects the inside of the pipe 50 and the toner supply opening 38*a* of the toner container 38, its range of sliding. A lower opening 50*b* is formed circumferentially in the lower half of the pipe 50 (at the right end in FIG. 10). A spiral 51 is provided rotatably in the pipe 50, whereby toner dropped from the toner container 38 is transported to the end of the toner supply pipe 50. A rod 51*a* of the spiral 51 protrudes from the hopper 21 through the end of the operator side (or the left side in FIG. 10) of the toner supply pipe 50 and the end of the cylindrical casing 49. Referring to FIG. 10; when the front cover 19 of the machine body 1 is closed, the front cover 19 pushes the end of the rod 51*a* with its inner surface. Accordingly, the toner supply pipe 50 is pushed into the machine body 1, and the other end of the pipe 50 moves into the opening 20*a* of the developing device 20.

In order to close the lower opening 50*b* of the pipe 50, a cover 52 slidably fits onto the tip-end portion of the toner supply pipe 50. The cover 52 can move along the toner supply pipe 50 and is always tensed toward the other end of the toner supply pipe 50 by a spring 53.

Figure 12:
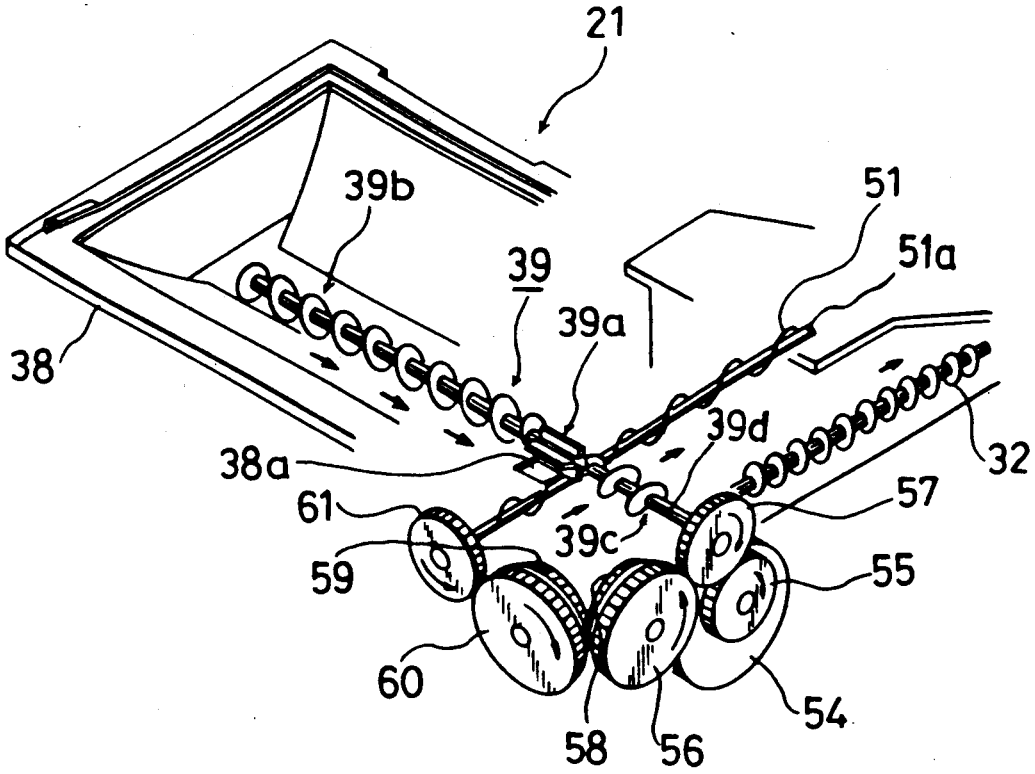

Referring to FIGS. 8, 10 and 12; a drive gear 55 is connected to a drive motor 54 in the right (in FIG. 8) end part of the hopper 21. The drive gear 55 is connected to the rod 39*d* of the transfer means 39 through a first link gear 56 and a gear 57 for toner supply. As shown in FIG. 8, the first link gear 56 is connected to a first bevel gear 58, and the bevel gear 58 is connected to a small gear 61 via a second bevel gear 59 and a second link gear 60 integrally formed thereon. The small gear 61 is fixed to the rod 51*a* extending outward from the hopper 21, accordingly thereby, the drive gear 55 drives the spiral 51.

Toner Cartridge

Figure 18:
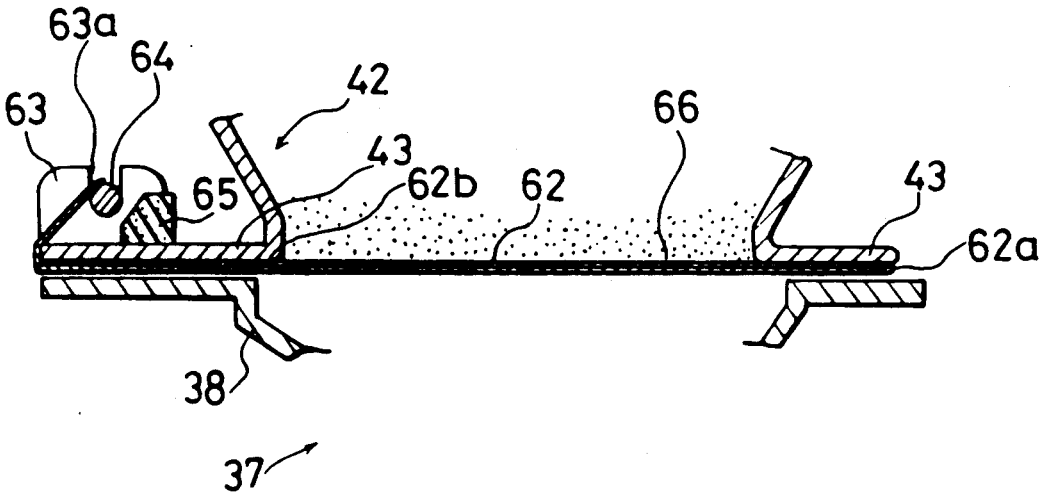
FIG. 18 is a sectional view showing a rolling mechanism for rolling up the seal member.
Figure 16:
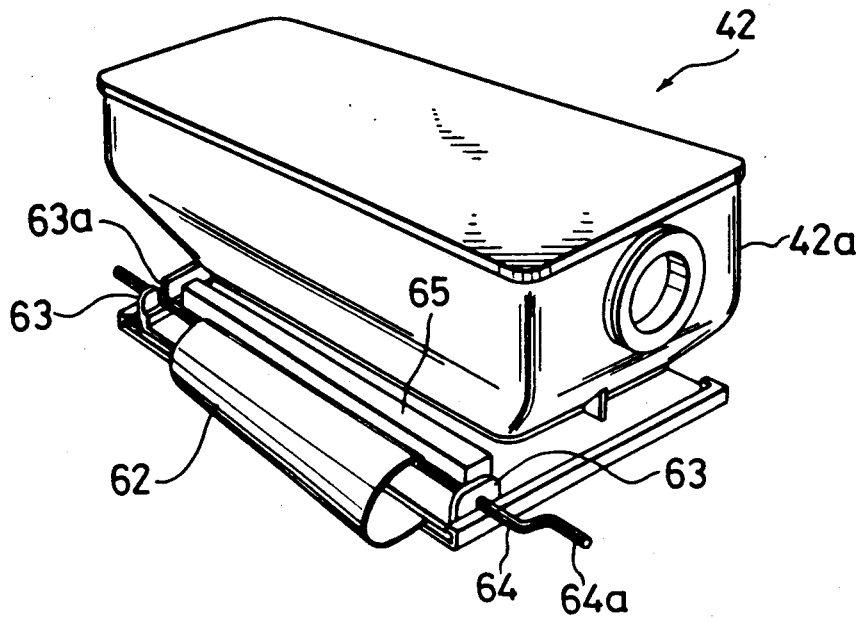
FIG. 16 is a perspective view showing an appearance of a toner cartridge.
Figure 17:
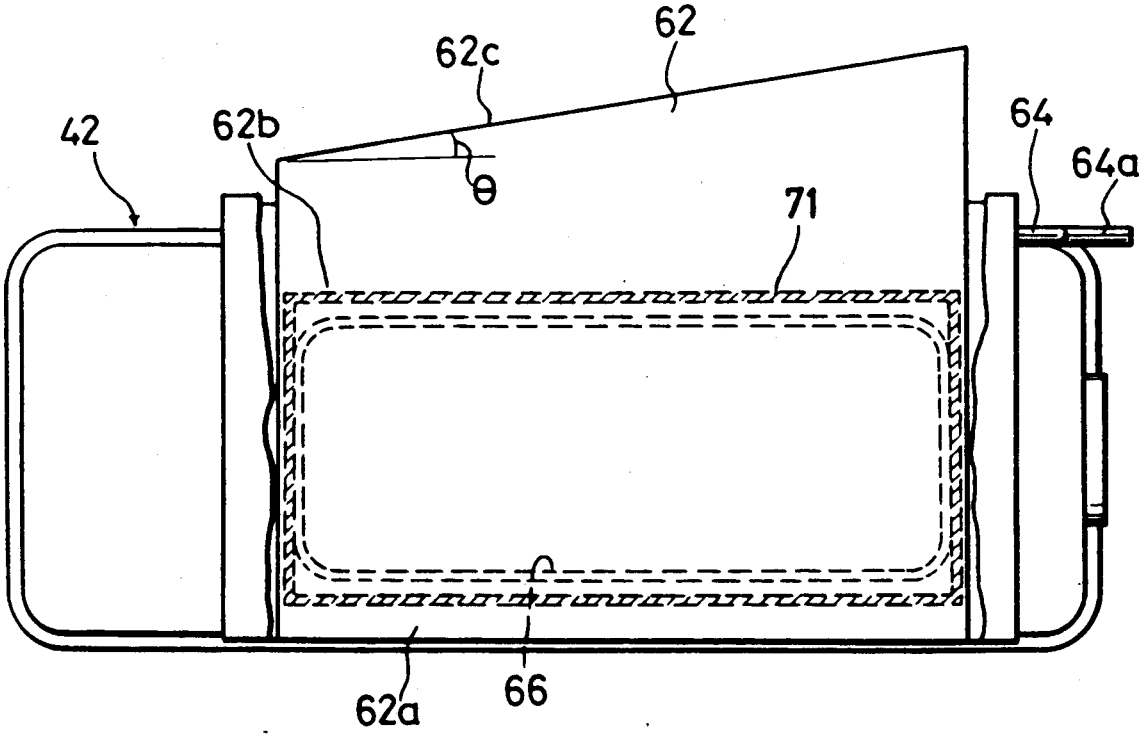
FIG. 17 is a bottom view showing the toner cartridge with a seal member unfixed to a roller.

The toner cartridge 42 is for storing toner and supplying the toner to the toner container 38. Referring to FIGS. 16–18; the toner cartridge 42 consists of a cartridge body 42*a*, a seal member 62 and a rolling-up mechanism.

The cartridge body 42*a* is box-shaped and has an opening 66 at the bottom end. There are sloping walls in the lower part of the cartridge body 42*a* whereof the lower ends are closer to each other than the upper ends. The flange 43 is formed at the bottom end, as described above, and is slid into the holders 40 and 41 of the hopper body 37 when the cartridge 42 is to be attached to or detached from the hopper body. As shown in FIG. 10, there is a hole 43*a* for locking, into which a locking projection 38*b* of the toner container 38 is engaged to fix the toner cartridge 42 when the cartridge body 42*a* is set onto the hopper body 37.

Referring to FIG. 18; the cartridge 42 has the opening 66 closed by the folded seal member 62 before use. On the flange 43, there is a mechanism with which the seal member 62 is rolled up when the cartridge body 42*a* is set onto the hopper body 37. The mechanism consists of a supporter 63, a roller 64 and a pressing member 65. The supporter 63 is formed integrally on the operator-side part of the flange 43.

The supporter 63 has a U-shaped notch 63*a* into which the roller 64 is received rotatably. The folded seal member 62 is adhered to the roller 64 at the free end. The roller 64 has a crank-shaped end portion 64*a* for handling, referred to as a roll-up handle. The pressing member 65, made of resin having a sponge-like elasticity, extends in the lengthwise direction of the seal member 62 along the roller 64. The pressing member 65 presses on the outer surface of the seal member 62 when it is rolled by the roller 64.

The seal member 62, as shown in FIG. 18, has a folded part 62*a* and closes the toner supply opening 66 with the part between the folded part 62*a* and the adhered end 62*b*. In FIG. 17, the area shown with oblique lines is an adhered part 71 between the seal member 62 and the peripheral portion of the opening 66. At the adhered part 71, the seal member 62 is fixed to the cartridge body 42*a* with adhesive to be removed by proper force.

As shown in FIG. 17, the seal member 62 is trapezoid-shaped, so that the measures between the folded part 62*a* and the rolling end 62*c* on the opposite sides of the seal member 62 are different. Via the line of the rolling end, 62*c* meets the direction of the roller 64 at an angle $\theta$, so that the side of the seal member 62 nearer the roll-up handle 64*a* is longer than the opposite side. As the angle $\theta$ is increased, less force is required to remove the seal member 62 at the adhered part 71, but the roller 64 must be longer, because the rolled end 62C is thereby longer. Therefore, the angle $\theta$ must be so set that the roller 64 is not too long to handle. If due to a greater angle $\theta$, the seal member cannot be suitably rolled by the roller 64, to thereby make a roll like a spiral shell, a roller may be used which has diameters different between both ends.

The rolling end 62*c* of the seal member 62 is fixed to the roller 64 with proper adhesive material, wherein the line of the rolling end 62*c* is extended in parallel with the roller 64. This fixing work is usually performed in a manufacturing process. Since the side of the seal member 62 near the handle 64*a* is longer than the other side in terms of the length between the folded part 62*a* and the rolling end 62*c*, the side near the handle 64*a* is slackened more than the other side due to the difference in length, as shown in FIG. 16.

Setting for Use

When the developing unit 10 is set in the machine body 1, as shown in FIG. 10, the hopper 21 is fixed to the developing device 20 and then the front cover 19 is closed. Thus, the end portion of the toner supply pipe 50 is inserted into the connecting opening 20*a* of the developing device 20, because the inside surface of the front cover 19 pushes the rod 51*a* toward the right (in FIG. 10). The end of the cover 52 on the toner supply pipe 50 touches the edge of the opening 20*a* of the developing device 20, and thereupon the cover 52 is moved backward in relation to the toner supply pipe 50, pressing the spring 53, to open the lower opening 50*b* of the toner supply pipe 50.

Toner Supply

The transporting route of toner is shown in FIG. 12. The spiral 32 of the developing device 20 is continually rotated by a driving system, not shown. However, the transfer means 39 and the spiral 51 of the hopper 21 are usually stopped.

When a toner supply instruction is outputted in a copying process due to toner consumption, the drive motor 54 starts and the drive gear 55 of the hopper 21 rotates. The rotation of the drive gear 55 is transferred to the transfer means 39 through the first link gear 56 and the toner supply gear 57. As the transfer means 39 rotates, one portion of toner in the left side (in FIG. 8) is transported by the spiral part 39*b*, and another portion in the right side (in FIG. 8) is transported by the spiral part 39*c* to the rotor 39*a*, respectively. The rotor 39*a* permits a constant amount of toner to go down through the toner supply opening 38*a*, by means of the wings 45.

In addition to the rotation of the transfer means 39, the rotation of the first link gear 56 is transferred to the small gear 61 through the bevel gears 58 and 59 and the second link gear 60. Accordingly, the rod 51*a* connecting with the small gear 61 rotates to cause the spiral 51 to rotate. As a result, toner dropped from the supply opening 38*a* is transported in the toner supply pipe 50 to the right (in FIG. 10). The toner transported by the spiral 51 is supplied to the supply part 20*c* of the developing device 20 through the lower opening 50*b* of the toner supply pipe 50.

The toner supplied to the toner supply part 20*c* of the developing device 20 is transported in the longitudinal direction of the supply part 20*c* by the spiral 32. Since a slot 20*b* extends in the longitudinal direction below the spiral 32, the toner is supplied through the slot 20*b* to the agitation roller 31 and the scooping rotor 30. Then, when the concentration of toner reaches a predetermined level, the toner supply instruction stops, and the drive motor 54 of the hopper 21 stops, thereby halting the toner supply operation.

In the toner supply operation as described in the above, since the toner supply opening 38*a* is located not at the end, but in the middle of the hopper 21, the transportation distance of toner in the toner container 38 is thereby short. Therefore, the residence time of toner located at the lateral ends of the container 38 in the beginning is reduced, so that less amount of toner can adhere to the inner surfaces of the container 38.

The rotor 39*a* of the transfer means 39 permits only the predetermined amount of toner to fall through the opening 38*a*, and this rotor 39*a* closes the opening 38*a* with its wings 45 when the rotor 39*a* stops. Therefore, the toner cannot be over-supplied, and thereby neither an excessive-toner problem nor a spreading-toner problem can occurs.

Toner Movement

In the above toner supply operation, the rod 39*d* rotates to rotate the spiral part 39*b*. Since the spiral part 39*b* contacts the bottom ends of the side swing plates 46 towards each of its ends, the bottom ends of the swing plates 46 are alternately pushed up by the spiral and not pushed while the spiral 39*b* is rotating. As a result, the bottom parts of the side swing plates 46 pivot on the upper part. Furthermore, the rear swing plate 48 also swings by the oscillation of the side swing plates 46, since both side ends of the rear swing plate 48 are on the side swing plates 46.

The front swing plate 47 also swings similarly to the above, since the projection 47*a* of the front swing plate 47 is on one of the wings 45, and the bottom end of the front swing plate 47 is pushed up by the wings 45, and not contrariwise, due to the rotation of the rotor 39*a*.

Thus, the swing plates 46–48 swing against the four slopes in the toner container 38 when the toner is supplied, so that the toner in the toner container 38 can move down to the bottom, thereby not remaining on the slopes.

Exchanging Developing Device

Figure 19:
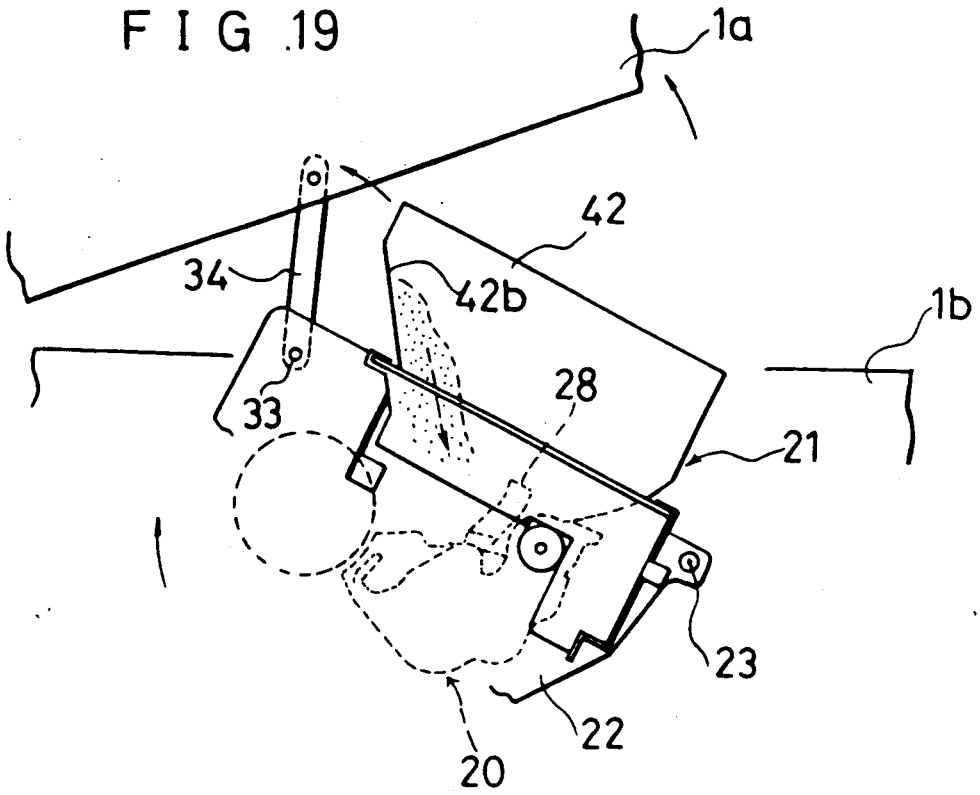
FIG. 19 is a view showing a developing unit which is being exchanged.

The operation will be described as when the developing device 20 is exchanged to change developing colors. The hopper 21 usually contains toner of a particular color such as black, which is the most frequently used. When the developing color is changed to red, for example, the lock between the upper portion 1*a* and the lower portion 1*b* of the machine body 1 in FIG. 6 is opened, and the upper portion 1*a* is rotated in the counterclockwise direction about the hinge 18 to open the body 1. Opening the upper portion 1*a* pulls up the link member 34, so that the front plate 22 and the rear plate, connected to the link members 34 with the pins 33, rotate clockwise about the fulcra 23. The present situation is shown in FIG. 19. Under the condition of FIG. 19, the developing device 20 is able to come out upward from the machine body.

Then, the rod 51*a* of the hopper 21 is pulled toward the operator, so that the rod 51*a*, the spiral 51 and the toner supply pipe 50 move to the left (in FIG. 10, as shown with phantom lines). As a result, the right end portion of the toner supply pipe 50 comes out from the opening 20*a* of the developing device 20 so that the hopper 21 and the developing device 20 are disconnected. Subsequently, the developing device 20 is pulled up by grasping the handle 28, so that the support members 26 and 27 come out from the pockets P1 and P2 of the side plates, and the developing device 20 slides up along the guides 24 and 25 to the outside of the machine body 1.

Next, a red developing device 20 which contains red toner, for example, is inserted into the machine body 1, and the support members 26 and 27 are made to go down along the guides 24 and 25 of the plate 22. Thereby, the support members 26 and 27 are supported by the pockets P1 and P2. Since the surface of the guide 25 supporting the support member 26 is a part of the arc of radius R thereof the center coincides with that of the photoconductive drum 8, the distance between the developing roller 29 and the photoconductive drum 8 is maintained strictly at the predetermined value, even if the position of the support member 26 is different from the predetermined position in the vertical direction.

After the developing device 20 is supported by the pockets P1 and P2, the rod 51*a* of the hopper 21 is pushed by the operator. However, the developing device 20 containing red toner does not have the connecting opening 20*a* and the spiral 32 which are provided in the black developing device. Therefore, there is no portion which pushes back the cover 52, so that the lower opening 50*b* of the toner supply pipe 50 is still covered by the cover 52 due to the pressure of the spring 53, even if the toner supply pipe 50 of the hopper 21 is pushed. Furthermore, in this case, a detector such as a switch (not shown) detects the inserted developing device 20, which is not the black developing device 20, so that the motor for supplying toner is not activated.

When the former black developing device 20 is reinserted, the black developing device 20 is supported by the pockets P1 and P2 through an operation similar to the above operation. The rod 51*a* is then pushed by the operator, whereby the end of the toner supply pipe 50 is inserted into the opening 20*a* of the developing device 20. Even if the operator does not push the spiral axis 51*a*, the front cover 19 pushes the spiral axis 51*a* with its inner surface when the cover 19 is closed, thereby the end of the toner supply pipe 50 automatically moves into the opening 20*a* of the developing device 20.

In the above exchange operation of the developing devices 20, the surface of the photoconductive drum 8 is not damaged, because the developing devices 20 can slide downwards to be installed and upwards to be withdrawn, guided by the guides 24 and 25. Furthermore, since only the developing devices 20, a part of the developing unit, are exchanged when the developing color is changed, the operation is facilitated. This developing unit can be used when a great number of copies in a particular color must be made, because a particular color toner can be stored in the toner cartridge 42 of the hopper 21.

Since the toner supply pipe 50 is inserted in the developing device 20 by the movement of the front cover 19 of the machine body 1, the hopper 21 and the developing device 20 are automatically connected when the developing devices 20 are exchanged. In addition, since the lower opening 50*b* of the toner supply pipe 50 is automatically covered by the cover 52 when the developing device 20 of a color instead of the particular color (black in the above embodiment) is used, the particular-color toner does not leak out.

Furthermore, in the above developing unit, the toner cartridge 42 tilts as shown in FIG. 19 when the developing devices 20 are exchanged, so that any portion of toner remaining on the sloping part 42*b* of the toner cartridge 42 drops to the bottom of the container. This means that all the toner can drop smoothly, even wherein a toner cartridge 42 has been expanded laterally to increase its volume.

Installing Toner Cartridge

Before a new toner cartridge 42 can be installed in the developing unit, an empty toner cartridge 42 must be drawn out in the horizontal direction, therein pressing down the projection 38*b*, and then thrown away. Subsequently, the new toner cartridge 42 is slid in the horizontal direction, with its flange 43 inserted into the holders 40 and 41 of the toner container 38. As a result, the projection 38*b* is engaged with the hole 43*a*, formed in the flange 43, to lock the new toner cartridge 42.

Figure 21:
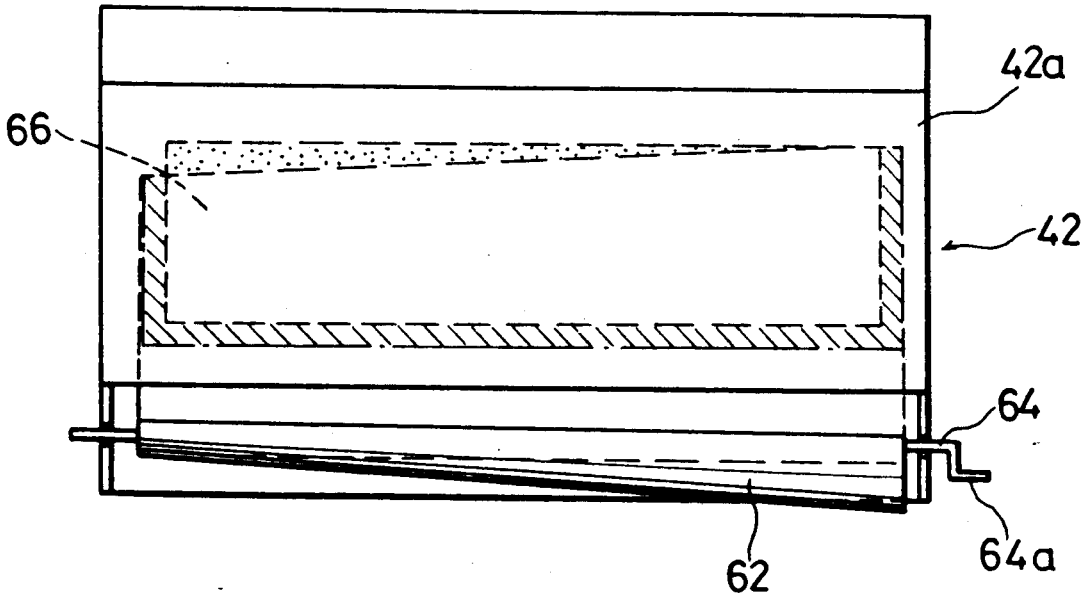
FIGS. 20A–20C and 21 are views for explaining the function of the mechanism of rolling up the seal member.
Figure 20A:
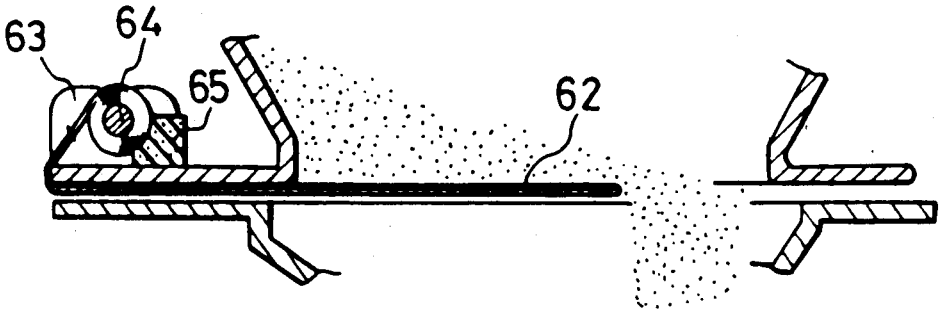
Figure 20B:
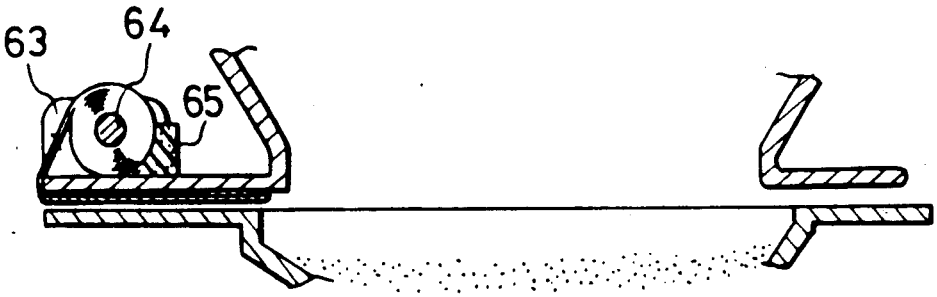

Next, the roller 64 is rotated clockwise (in FIG. 18) in order to roll up the folded seal member 62 as shown in FIGS. 20A and 20B. Since every rolled part of the seal member 62 has the same length on every part of the roller 64, as shown in FIG. 21, the slackened part of the seal member 62 near the handle 64*a* is still maintained when removal of the seal member 62 starts. When the seal member 62 is removed by rolling, part of the side shortest in the length between the folded part 62*a* and the rolling end 62*c*, specifically the part of the seal member 62 farthest from the handle 64*a*, is the first to start leaving the container 38. FIG. 21 shows the condition, in which the seal member 62 is removed diagonally with respect to its folded part, so that the toner in the cartridge body 42 drops little by little whereby it is supplied.

In this embodiment, the greatest area of the adhered part to be removed at any given moment is always less than that in the conventional example, so that the maximum force required in removing the seal member 62 is reduced. Particularly, at the beginning of removal of the seal member 62, the required force is rduced over that of the conventional example, whereby the facility of operation is improved.

Figure 20C:
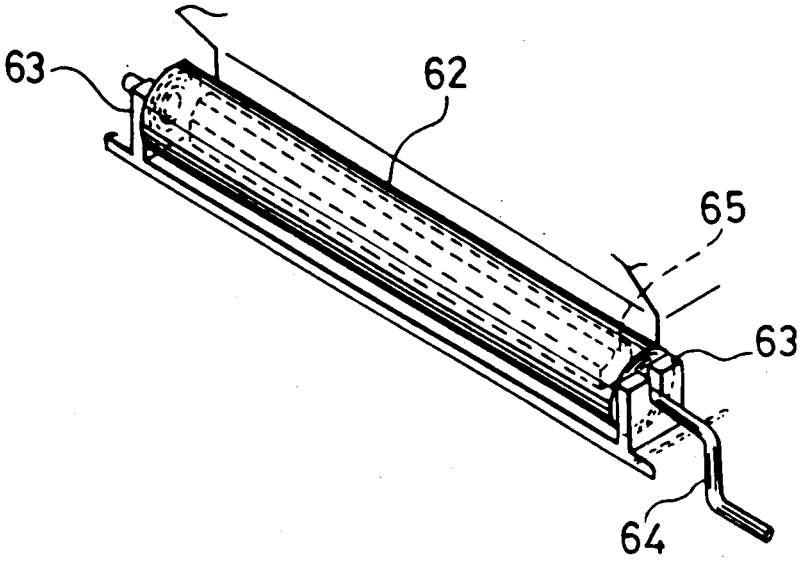

As the seal member 62 is rolled up by the roller 64, its outer surface is pressed by the pressing member 65, as shown in FIG. 20C. Since the rolled-up seal member 62 is pressed by the pressing member 65, expansion of the diameter of the rolled seal member 62 due to its elasticity does not occur. Furthermore, the pressing member 65 can clean the seal member 62 of toner adsorbed on its surface, as the seal member 62 is rolled up. Therefore, the rolling-up mechanism in this embodiment does not require any one-way mechanism to fix the direction of rolling, whereas a conventional rolling mechanism needs a one-way mechanism to ensure that the surface of the seal member with toner is always placed inside. Moreover, since the pressing member 65 keeps the rolled seal member 62 from expanding, as described above, the variety of the material which may constitute the seal member 62 is less limited; thereby the degree of freedom of its material is increased.

Figure 22:
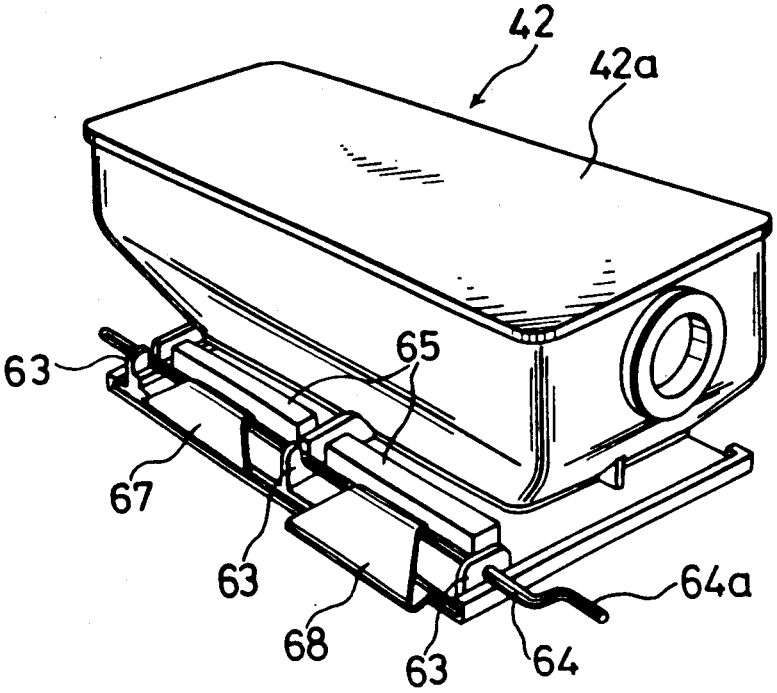
FIG. 22 is a perspective view showing a toner cartridge according to another embodiment.
Figure 23:
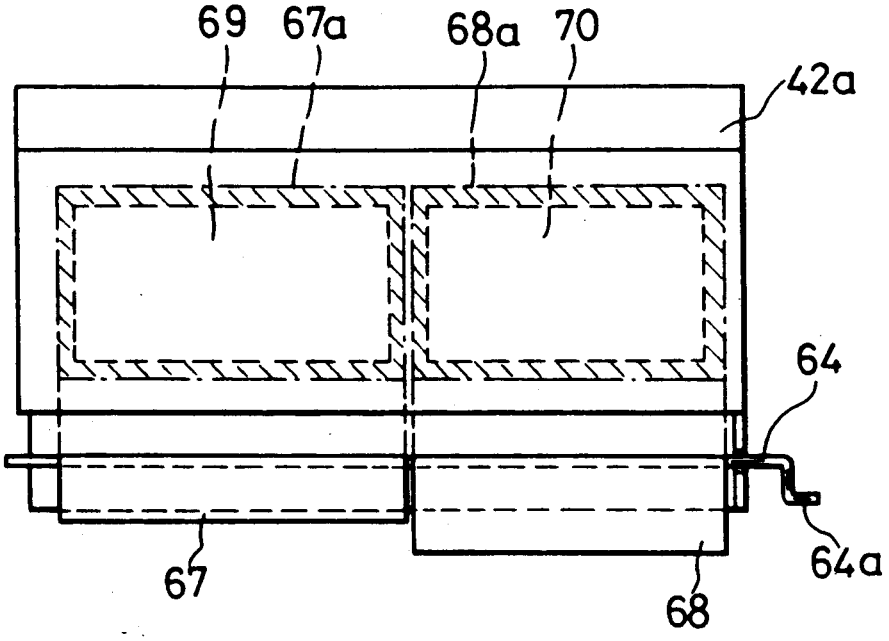
FIGS. 23–27 are bottom views showing toner cartridges according to other embodiments, respectively.

MODIFICATIONS (a) As shown in FIGS. 22 and 23, a first seal member 67 and a second seal member 68 having different lengths can be used, wherein the second seal member 68 is slacken more than the first seal member 67, whereas one seat comprises the seal member 62 in the above example.

In this example, the cartridge body 42*a* has a first opening 69 and a second opening 70 for supplying toner in correspondence with the first seal member 67 and the second seal member 68, as shown in FIG. 23.

As the seal members 67 and 68 begin to be rolled, the first seal member 67 leaves the cartridge body 42*a*, first, then the second seal member 68 begins to leave. Thereby, the force required at the start of rolling is reduced. Furthermore, by changing the difference of the lengths between the folded parts 67*a* and 68*a*, and the roller 64, in seal members 67 and 68, the timing whereupon the seal members 67 and 68 begin to leave can be controlled.

(b) Seal members of more than two seats may be used, whereas seal members of two seats are used in the embodiment shown in FIG. 22.

Figure 24:
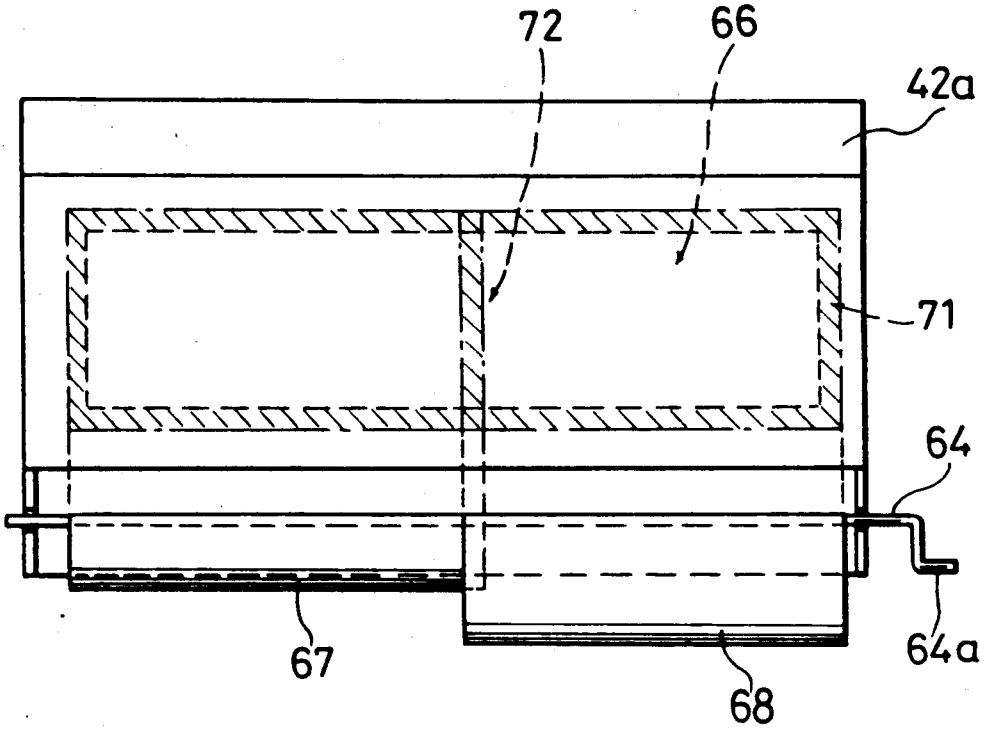

(c) FIG. 24 shows another embodiment according to the present invention. A toner cartridge body 42A has one toner supply opening 66, and first and second seal members 67 and 68 to close the opening 66. Provided between the first seal member 67 and the second seal member 68 is a stacked seal part 72 adhered similarly to the adhered part 71. At the adhered part 72, the second seal member 68 is located between the cartridge 42*a* and the first seal member 67.

In this embodiment, the first seal member 67 begins to leave first followed by the second seal member 68. On the roller 64, the second seal member 68 is stacked on the first seal member 67 in terms of the part 72.

Figure 25:
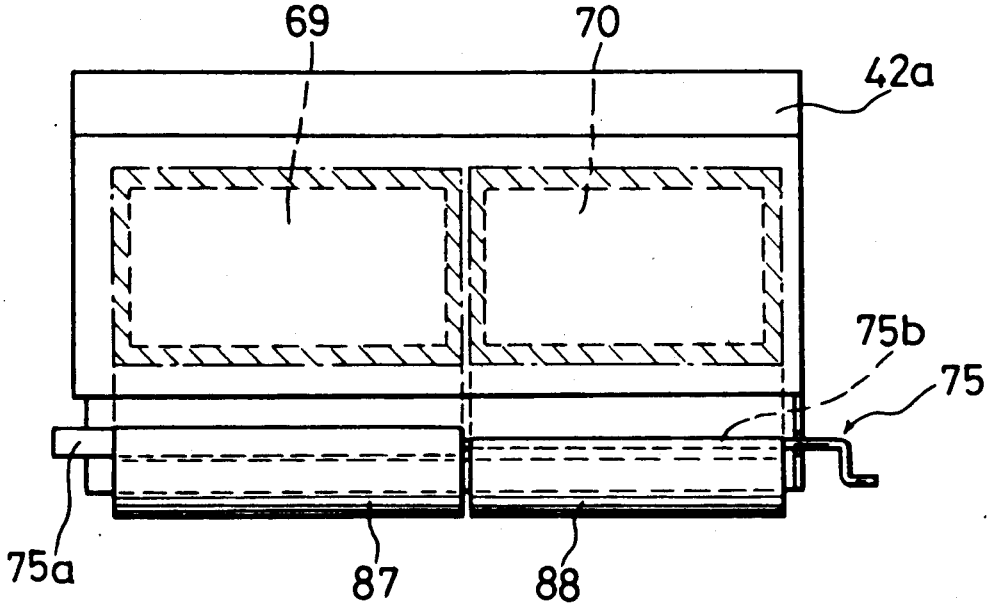

(d) A roller 75 having a large diameter part 75*a* and a small diameter part 75*b*, as shown in FIG. 25, can be used instead of the roller 64 described above. In this modification, the seal members 87 and 88 may have different lengths.

According to this modification, the required force of removal is minimal, because the peripheral speeds of the seal members 87 and 88 are different.

(e) In the embodiments shown in FIGS. 22-25, at least one of seal members may have a trapezoid shape similar to that in the embodiment shown in FIG. 17.

Figure 26:
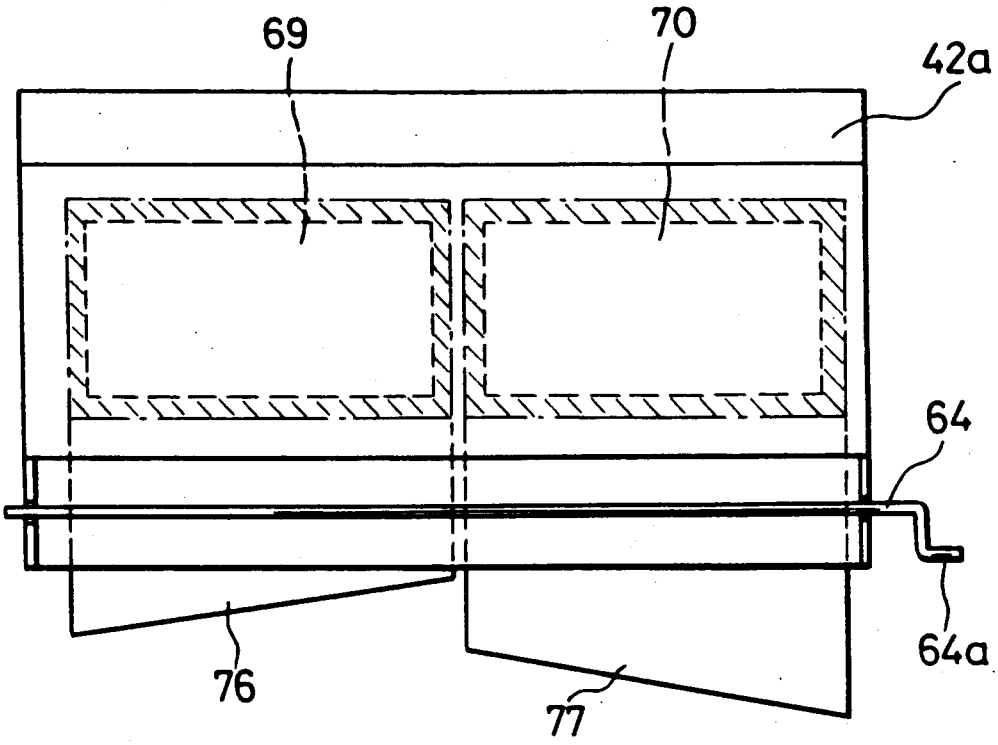

In FIG. 26, an embodiment includes two seal members 76 and 77 having trapezoid shapes. FIG. 26 shows the seal members 76 and 77 before these are attached to the roller 64.

Figure 27:
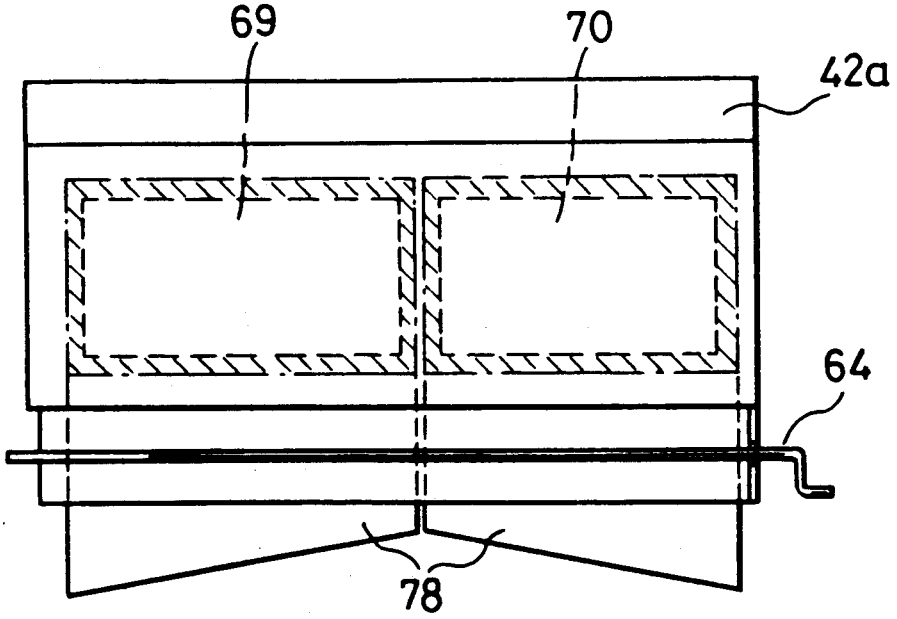

(f) FIG. 27 shows an embodiment in which each of two seal members 78 has the same length and trapezoid shape.

Figure 28:
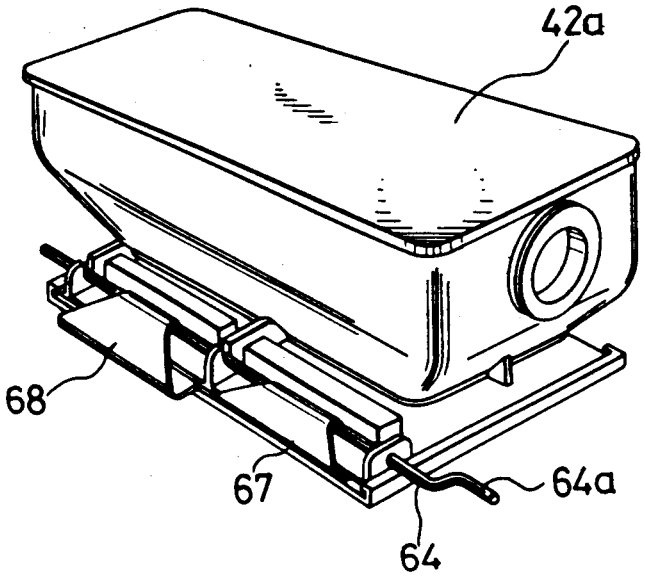
FIG. 28 is a perspective view showing a toner cartridge according to another embodiment.
Figure 29:
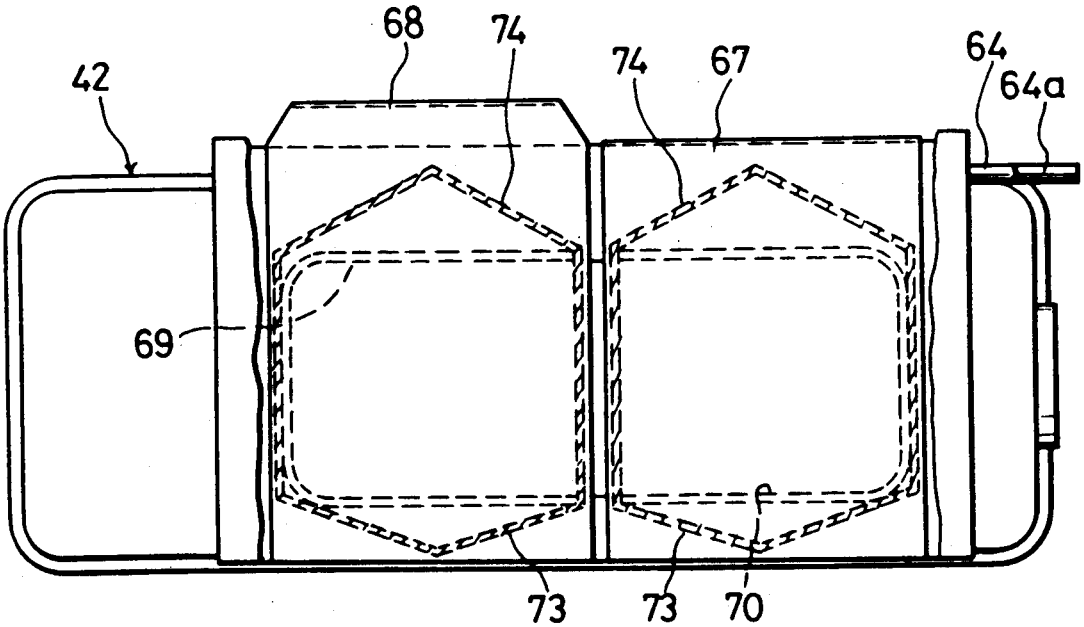
FIG. 29 is a bottom view showing the toner cartridge of FIG. 28.
Figure 30:
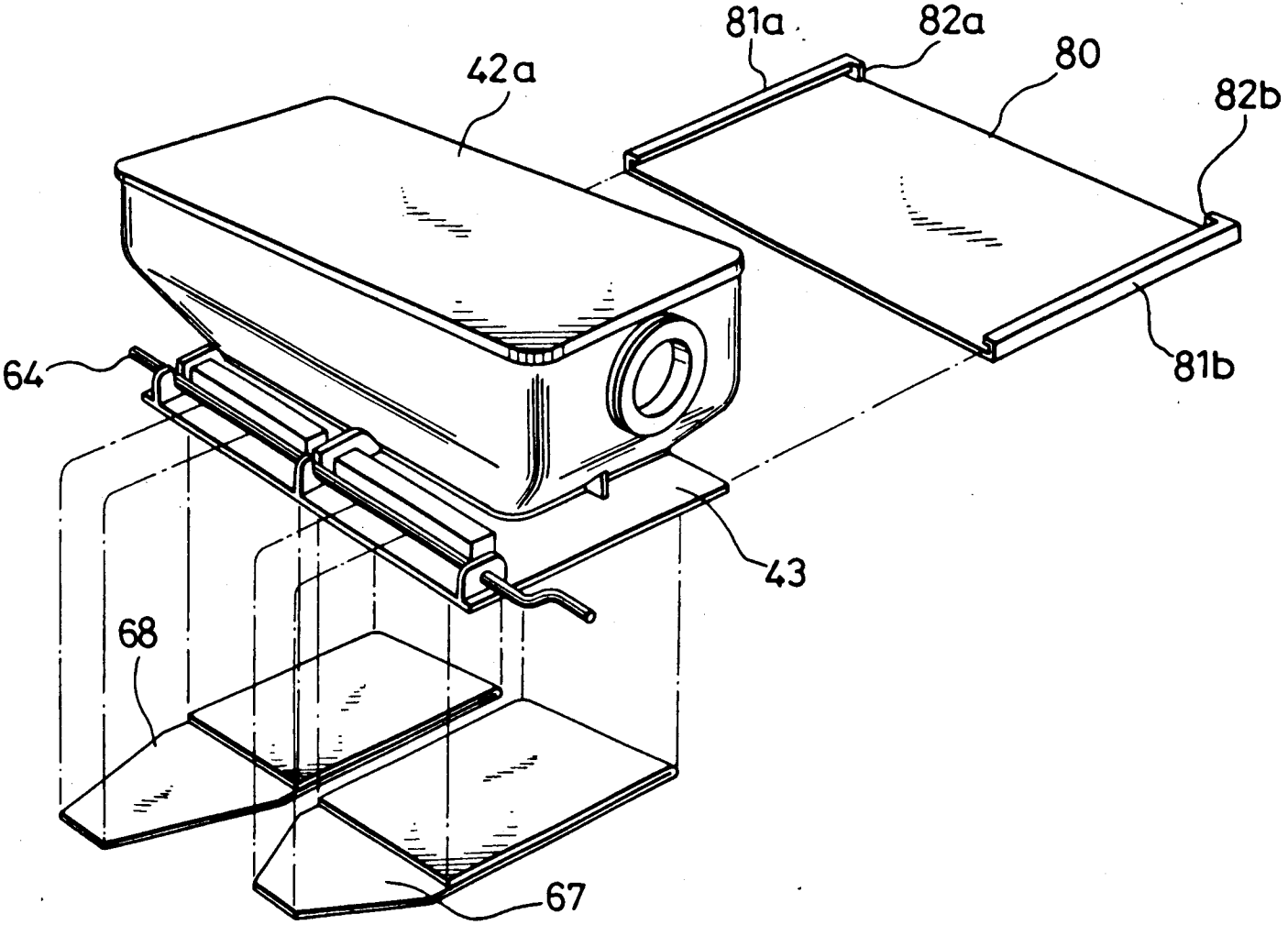
FIG. 30 is a perspective view showing the decomposed toner cartridge of FIG. 28.

(g) FIGS. 28–30 show another embodiment of the present invention.

In this embodiment, the cartridge body 42*a* has two openings 69 and 70 at the bottom. The opening 70 is closed by a first seal member 67, and the opening 69 is closed by a second seal member 68 longer than the first seal member 67. Counter to the above embodiment, the first seal member 67 is located adjacent to the handle 64*a* of the roller 64. Adhered parts 73 and 74 of the seal members 67 and 68 have mountain-like shapes whereof the center projects outward along the removing direction.

FIG. 30 is a perspective view showing the cartridge body 42*a* decomposed. A cover plate 80 is provided which can be attached to and detached from the bottom of the cartridge body 42*a*. The cover plate 80 can cover the openings 69 and 70 closed by the seal members 67 and 68.

At both ends along the lateral direction, the cover plate 80 has slide guides 81*a* and 81*b* which are C-shaped in sectional view. The slide guides 81*a* and 81*b* are to slidably fit onto both ends of the flange 43 of the cartridge body 42*a*. The ends of the slide guides 81*a* and 81*b* have stoppers 82*a* and 82*b* to stop the cover plate 80 at the position just below the flange 43.

When the cover plate 80 is set onto a new toner cartridge 42, the slide guides 81*a* and 81*b* are fitted onto the flange 43 of the cartridge body 42*a*, and then the cover plate 80 is slid until the stoppers 82*a* and 82*b* come in contact with the flange 43.

In this case, the cover plate 80 is slid from the side opposite to the side having the roller 64, as shown in FIG. 30. Therefore, the slackening part of the second seal member 68 cannot get forced into the narrow space between the flange 43 and the cover plate 80 when sliding of the cover plate 80. As a result, the seal members 67 and 68 can be smoothly removed from the flange 43, after the toner cartridge 42 is set on the hopper body of the machine body.

Figure 31:
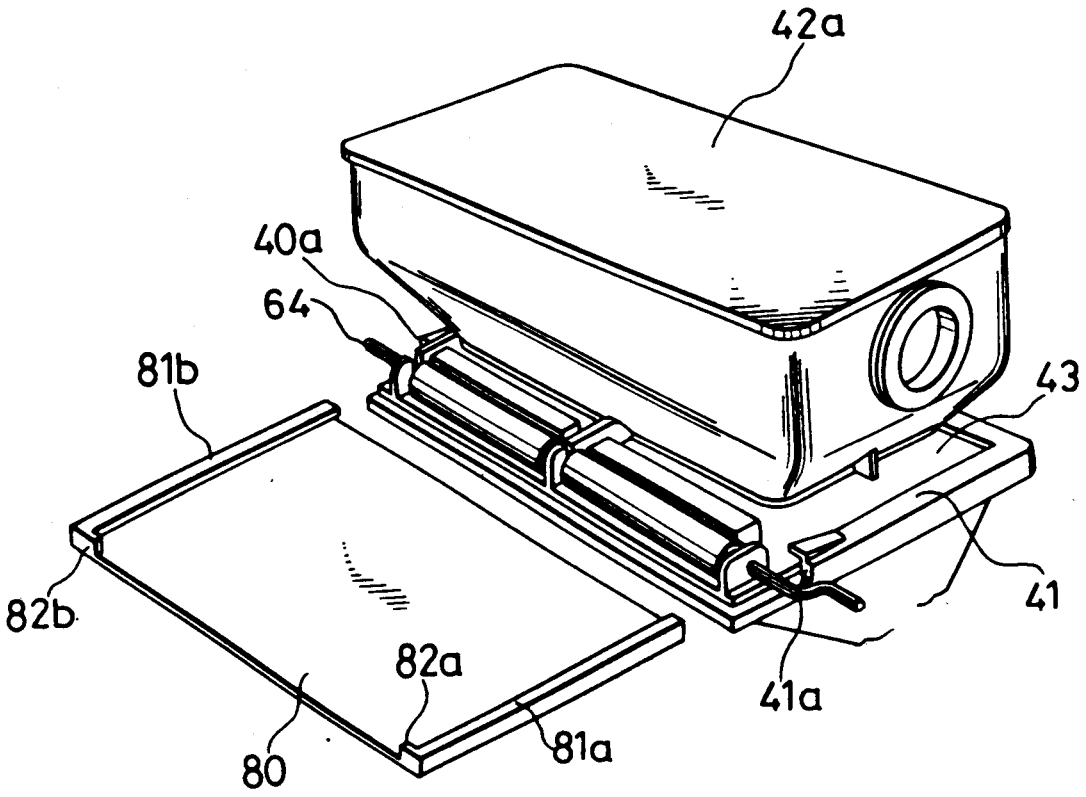
FIG. 31 is a perspective view for explaining an operation to detach the toner cartridge.
Figure 32:
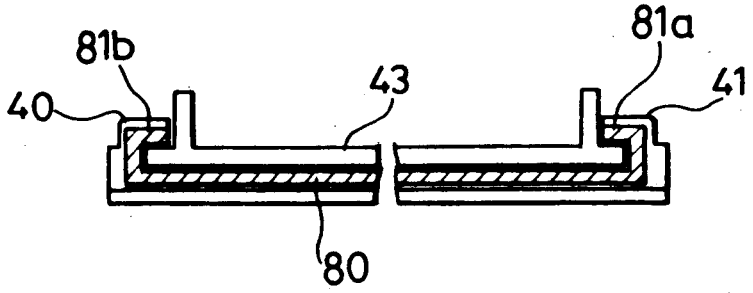
FIG. 32 is a sectional side view showing a part of the toner cartridge.

Meanwhile, when a used toner cartridge 42 is detached from the hopper body 37 of the machine body 1, an operation reverse to that in the above is carried out, as shown in FIG. 31. That is, the slide guides 81*a* and 81*b* of the cover plate 80 are fitted onto the flange 43 from the side nearer the roller 64 until the ends of the guides 81*a* and 81*b* opposite to the other ends having the stoppers 82*a* and 82*b* come in contact with ends 40*a* and 41*a* of the holders 40 and 41 of the hopper body 37. The condition at this moment is shown in FIG. 32, which is a sectional side view. As the end portion of the cover plate 80 is inserted, the cover plate 80 presses down the projection 38*b* of the hopper body 37 in FIG. 10, so that the toner cartridge 42 can be drawn out toward the operator. Thereupon, the toner cartridge 42 is horizontally drawn onto the cover plate 80 along the slide guides 81*a* and 81*b*.

Moreover, the toner cartridge shown in FIG. 16 can be operated in almost the same manner as the toner cartridge described in the above with FIGS. 30–32, wherein the cover plate 80 and the toner cartridge 42 are thereby handled.

(h) The roller 64 can be rotated counterclockwise when rolling up the seal member 62. By a counterclockwise rotation of the roller 64, the seal member 62 is made into a roll wherein the surface having toner is inside, so that less amount of toner scatters.

(i) In the embodiment of FIG. 16, one pressing member 65 extends the length of the seal member 62. Furthermore, a plurality of pressing members 65 may instead be located therein with spacing between each of them.

(j) A copying machine to which the present invention is applied is not limited to the clamshell type in which a copying machine body 1 consists of an upper portion 1*a* and a lower portion 1*b* for opening, although the present invention is applied to the clamshell type in the above embodiments. For example, the present invention may be applied to a copying machine having a slidable contact glass. In this type of copying machine, after the contact glass is slid out from its position over the machine body to make an opening in the upper portion, the developing units can be exchanged through the opening.

(k) The present invention can be applied to other types of image forming apparatuses, such as a printer and a facsimile, although the developing unit according to the present invention is applied to a copying machine in the above embodiments.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A toner cartridge comprising:

a cartridge body having a toner supply opening;

a seal member having a first end part, a second end part, a folded part, and a part for closing said toner supply opening which is located between said folded part and said first end part, said seal member having sides with different lengths between said folded part and said second end part; and rolling means for rolling up said seal member from said second end part of said seal member to remove said seal member from said cartridge body, whereby removal begins at a point on said second end part which is nearest said folded part.

2. A toner cartridge according to claim 1, wherein said rolling means comprises supporters and a roller having a handle at an end supported rotatably by said supporters.

3. A toner cartridge according to claim 2, wherein said seal member is trapezoidal, in which the rolling end extends in the direction crossing the direction of the axis of said roller; and said seal member is fixed to said roller so that the rolling end is parallel with the axis of said roller.

4. A toner cartridge according to claim 3, wherein said cartridge body is rectangular; and said roller has its axis extending along the longitudinal direction of said cartridge body.

5. A toner cartridge according to claim 3, wherein said cartridge body is box-shaped and has said toner supply opening at the bottom and a flange surrounding said toner supply opening; and said supporters are located on said flange.

6. A toner cartridge according to claim 5 further comprising a pressing member for pressing the outer surface of said seal member rolled up by said rolling means.

7. A toner cartridge according to claim 3 further comprising another seal member for closing said toner supply opening of said cartridge body.

8. A toner cartridge according to claim 7, wherein said seal member and said another seal member have different lengths between said folded parts thereof and said rolling means.

9. A toner cartridge comprising:

a cartridge body having a toner supply opening;

seal means including a plurality of seal members, each of said seal members having a first end part, a second end part, a folded part, and a part for closing said toner supply opening which is located between said folded part and said first end part, and having different lengths between said folded part and said second end part; and rolling means for rolling up each of said seal members from said second end part thereof to remove said seal members from said cartridge body, whereby removal begins at a point on said second end part which is nearest said folded part.

10. A toner cartridge according to claim 9, wherein said toner supply opening includes a first opening and a second opening; and said seal members include a first seal member for closing said first opening and a second seal member for closing said second opening.

11. A toner cartridge according to claim 10, wherein said rolling means has supporters and a roller having a handle at an end supported rotatably by said supporters.

12. A toner cartridge according to claim 11, wherein each of said seal members is adhered to said cartridge body, and the adhered part has an end line in the starting part of removing which curves out in the direction of removing.

13. A toner cartridge according to claim 12, wherein said cartridge body is box-shaped and has said toner supply opening at the bottom and a flange surrounding said toner supply opening; and said supporters are located on said flange.

14. A toner cartridge according to claim 13 further comprising a pressing member for pressing the outer surface of said seal members rolled up by said rolling means.

15. A toner cartridge according to claim 11, wherein said cartridge body is box-shaped and has said toner supply opening at the bottom and a flange surrounding said toner supply opening; and said supporters are located on said flange.

16. A toner cartridge according to claim 15 further comprising a pressing member for pressing the outer surface of said seal member rolled up by said rolling means.

17. A toner cartridge according to claim 11, wherein at least one of said seal members defines sides with lengths between said folded part and said roller which are different.

18. A toner cartridge according to claim 9, wherein said cartridge body has one toner supply opening; and said seal members include a first seal member and a second seal member having an adhered part therebetween.

19. A toner cartridge comprising:

a cartridge body having a toner supply opening;

seal means including a plurality of seal members, each of said seal members having a first end part, a second end part, a folded part, and a part for closing said toner supply opening which is located between said folded part and said first end part, and having different lengths between said folded part and said second end part;

rolling means for rolling up each of said seal members from said second end part thereof to remove said seal members from said members from said cartridge body, whereby removal begins at a point on said second end part which is nearest said folded part; and a pressing member comprising elastic means extending along said rolling means, for pressing an outer surface of said seal members as said members are rolled up by said rolling means, whereby bulging of said rolled seal members is minimized.

20. A toner cartridge according to claim 19, wherein said toner supply opening includes a first opening and a second opening; and said seal members include a first seal member for closing said first opening and a second seal member for closing said second opening.

21. A toner cartridge according to claim 20, wherein each of said seal members is adhered to said cartridge body, and the adhered part has an end line in the starting part of removing which curves out in the direction of removing.

22. A toner cartridge comprising:

a cartridge body having a toner supply opening;

a seal member for closing said toner supply opening;

rolling means, having a handle at an end and rotatably provided on said cartridge body, for rolling up said seal member; and a pressing member comprising elastic means extending along said rolling means for pressing an outer surface of said seal member as said member is rolled up by said rolling means, whereby bulging of said rolled seal member is minimized.

23. A toner cartridge according to claim 22, wherein said rolling means comprises supporters and a roller having a handle at an end supported rotatably by said supporters.

24. A toner cartridge according to claim 23, wherein said cartridge body is box-shaped and has said toner supply opening at the bottom and a flange surrounding said toner supply opening; and said supporters and said pressing member are located on said flange of said cartridge body.

25. A toner cartridge according to claim 24, wherein said pressing member is made of elastic resin.

26. A toner cartridge according to claim 24, wherein said pressing member extends between both ends of said seal member.

27. A toner cartridge according to claim 24, wherein said pressing member includes a plurality of pressing parts disposed in the widthwise direction of said seal member.

28. A toner cartridge comprising:

a cartridge body having a toner supply opening;

seal means including a plurality of seal members, each of said seal members having a first end part, a second end part, a folded part, and a part for closing said toner supply opening which is located between said folded part and said first end part, and having different lengths between said folded part and said second end part; and rolling means, provided on said cartridge body, for rolling up each said seal member; and a cover detachable from said cartridge body for covering said toner supply opening, said cover being attached to said cartridge body by sliding along said seal member from an end of said cartridge body located far from said rolling means.

29. A toner cartridge according claim 28, wherein said cartridge body is box-shaped and has said toner supply opening at the bottom and a flange surrounding said toner supply opening; and said cover includes slide guides on both side ends extending in the direction of sliding, fitting onto said flange.

30. A toner cartridge according to claim 29, wherein said cover is able to be attached to said flange of said cartridge body by sliding on the end of said flange near said rolling means.

31. A toner cartridge according to 29, wherein each of said slide guides has a stopper at an end for limiting a slide of said cover.

32. A toner cartridge comprising:

a cartridge body having a toner supply opening;

a seal member having a first end part, a second end part, a folded part, and a part for closing said toner supply opening of said cartridge body which is located between said folded part and said first end part, said seal member having sides with different lengths between said folded part and said end part;

rolling means, provided on said cartridge body, for rolling up said seal member; and a cover detachable from said cartridge body for covering said toner supply opening, said cover being attached to said cartridge body by sliding along said seal member from an end of said cartridge body located far from said rolling means.

* * * * *